US008132575B2

(12) United States Patent
Tojo et al.

(10) Patent No.: US 8,132,575 B2
(45) Date of Patent: Mar. 13, 2012

(54) HAIR HOLDER

(75) Inventors: Takehiko Tojo, Haga-gun (JP); Hideo Kobayashi, Haga-gun (JP); Koji Saito, Sumida-ku (JP); Shigeaki Wakana, Ichikawa (JP); Akemi Goto, Sumida-ku (JP); Manabu Sakashita, Sumida-ku (JP)

(73) Assignee: Kao Corporation, Tokyo (JP)

( * ) Notice: Subject to any disclaimer, the term of this patent is extended or adjusted under 35 U.S.C. 154(b) by 654 days.

(21) Appl. No.: 12/281,443

(22) PCT Filed: Mar. 1, 2007

(86) PCT No.: PCT/JP2007/053961

§ 371 (c)(1),
(2), (4) Date: Dec. 24, 2008

(87) PCT Pub. No.: WO2007/100062

PCT Pub. Date: Sep. 7, 2007

(65) Prior Publication Data

US 2009/0211594 A1 Aug. 27, 2009

(30) Foreign Application Priority Data

Mar. 3, 2006 (JP) ..... 2006-058554
May 16, 2006 (JP) ..... 2006-136412
Nov. 30, 2006 (JP) ..... 2006-325051

(51) Int. Cl.
*A45D 19/18* (2006.01)

(52) U.S. Cl. ..... 132/270

(58) Field of Classification Search ..... 132/270, 132/272, 212

See application file for complete search history.

(56) References Cited

U.S. PATENT DOCUMENTS

| | | | | |
|---|---|---|---|---|
| 3,871,388 | A * | 3/1975 | Leoci | 132/223 |
| 4,398,549 | A * | 8/1983 | Thomas | 132/270 |
| 4,552,159 | A * | 11/1985 | Fabbri et al. | 132/207 |
| 5,771,906 | A | 6/1998 | De Benedictis | |
| 6,647,989 | B1 * | 11/2003 | De Benedictis | 132/210 |
| 7,198,049 | B2 * | 4/2007 | Elmer et al. | 132/208 |
| 2004/0031502 | A1 | 2/2004 | Winckels et al. | |
| 2004/0216759 | A1 | 11/2004 | Elmer et al. | |
| 2004/0231689 | A1 | 11/2004 | Kobayashi et al. | |

FOREIGN PATENT DOCUMENTS

| | | |
|---|---|---|
| JP | 9 509348 | 9/1997 |
| JP | 2003 93133 | 4/2003 |
| JP | 2003-93133 | 4/2003 |
| JP | 2004 41723 | 2/2004 |
| JP | 2005 253942 | 9/2005 |

OTHER PUBLICATIONS

Japanese Office Action issued Feb. 22, 2011, in Patent Application No. 2006-136412 (with English-language translation).
Extended Search Report issued Apr. 20, 2011 in Europe Application No. 07737631.7.

* cited by examiner

*Primary Examiner* — Rachel Steitz
(74) *Attorney, Agent, or Firm* — Oblon, Spivak, McClelland, Maier & Neustadt, L.L.P.

(57) ABSTRACT

A hair holder including a tube configured to allow a hair bundle to be inserted from a one-end opening toward an other-end opening. The hair holder is designed to allow hair treatment to be applied inside the tube to the hair bundle by supplying a hair treating agent into the tube. A hair-treating-agent leak-prevention member is provided on an inner-surface side of the tube in the vicinity of the one-end opening, the hair-treating-agent leak-prevention member achieving an effect of preventing leakage of the agent when pressed against the hair bundle.

26 Claims, 15 Drawing Sheets

HAIR HOLDER

TECHNICAL FIELD

The present invention relates to a hair holder capable of applying hair treatment, such as a dyeing treatment and permanent-wave treatment, to a prescribed amount of hair.

BACKGROUND ART

Hair holders formed of a tube and capable of, for example, dyeing or permanent-waving a prescribed amount of hair are conventionally known. These types of hair holders are formed of a flexible tube and are so designed that a hair bundle is inserted into the tube from one end thereof. For example, in dyeing a hair bundle, a dyeing agent which serves as a hair treating agent is supplied into the tube and is applied inside the tube to the hair bundle.

Using a material that is impermeable to dyeing agents as the material forming the tube prevents dyeing of hair other than the portion of hair inserted in the hair holder, and thus, partial hair dyeing is achieved effectively.

Also, there are cases in which the dyeing agent is supplied into the tube from the other end of the tube which is on the opposite side from the one end through which the hair bundle is inserted. The dyeing agent in this case is spread and applied onto the hair bundle by stroking the tube from the other-end side toward the one end.

Applicant proposes a hair holder in previously-filed Patent Document 1 (see below) as an example of a hair holder of the above-mentioned type which is formed of a tube. This hair holder is formed of a flat tube made of a long narrow flexible material having a hair inlet at one end thereof, and includes roll-up means for curling or bending hair by rolling up the hair held by the tube into a prescribed shape.

Patent Document 2 discloses a hair holder formed of a tube designed so that a hair bundle can be inserted from an opening at one end toward an opening at the other end. The tube is made of a soft material.

Patent Document 1: JP2003-93133 A
Patent Document 2: US2004/216759 A1

DISCLOSURE OF THE INVENTION

In the hair holder disclosed in Patent Document 1, operating the roll-up means with a portion of hair on the head being inserted in the tube causes the tube to deform together with the hair bundle inserted therein, thus fixing the hair holder to the hair bundle. However, merely fixing the hair holder to the hair bundle inside the tube may cause the tube to fall off from its initially-fixed position on the hair bundle during hair treatment operations. For example, the hair holder is prone to fall off in cases where the roll-up means does not sufficiently roll up the hair bundle.

There also is a possibility that the hair treating agent may leak out from the one end when the dyeing agent supplied from the other end is spread out and applied onto the hair bundle having been inserted inside the tube from the one end by stroking the tube.

The problems mentioned above could be solved by pinning down the hair from above the hair holder using a high-strength clip, for example. This, however, is not preferable because applying such a force onto the hair wet with the hair treating agent may cause hair damage.

The hair holder disclosed in Patent Document 2, on the other hand, does not require any hair treating agent to be supplied anew into the tube. There is, however, a possibility that the hair treating agent may leak at the time of stroking the tube to make the hair treating agent adapt onto the hair bundle.

One reason for possibly causing the hair treating agent to leak from the one end of the tube in the hair holder disclosed in Patent Document 1 is that the range for stroking the tube from the other-end side toward the one end is not clear. This is the same for the hair holder disclosed in Patent Document 2.

Further, a conventional hair holder is typically used by supplying the hair treating agent to the tube from a container containing the hair treating agent. This, however, may cause unevenness in dyeing or bleaching in cases where the amount of hair treating agent supplied into the tube is too small and not enough agent is spread out onto the entire hair bundle, or cause leaking of the agent from the opening of the tube on the side opposite from the side where the agent has been supplied in cases where the amount of hair treating agent supplied into the tube is too large.

From the viewpoint of efficient hair treatment etc., it is preferable to fill the container with an amount of hair treating agent more than it is necessary for carrying out the hair treatment once, and to use a plurality of hair holders for applying the hair treatment. In this case, however, if a more-than-necessary amount of agent is supplied to each hair holder, then the hair treating agent will run out, thus making the intended number of times of hair treatments impossible. On the other hand, not supplying a suitable amount of agent to each hair holder may result in the hair not being dyed to the color desired or cause coloring unevenness. The hair treating agent will also be left over, thus being uneconomical.

An aspect of the present invention provides a hair holder including a tube configured to allow a hair bundle to be inserted from a one-end opening at one end of the tube toward an other-end opening at the other end thereof, the hair holder being designed to allow hair treatment to be applied inside the tube to the hair bundle by supplying a hair treating agent into the tube, wherein a hair-treating-agent leak-prevention member is provided on an inner-surface side of the tube in a vicinity of the one-end opening, the hair-treating-agent leak-prevention member achieving an effect of preventing leakage of the agent when pressed against the hair bundle. (The above-described structure is referred to hereinbelow as the "first aspect of the invention".)

Another aspect of the present invention provides a hair holder including a tube formed of a sheet in such a design as to allow a hair bundle to be inserted from a one-end opening at one end of the tube toward the other end thereof, the hair holder being designed to allow a hair treating agent supplied to the tube to be spread and applied onto the hair bundle having been inserted into the tube from the one-end opening by stroking of the tube, wherein the hair holder has a leak-prevention mark for preventing the hair treating agent from leaking out from the tube. (The above-described structure is referred to hereinbelow as the "second aspect of the invention".)

Preferably, a section indicating an endpoint of a range for stroking the tube in such a manner that the endpoint can be perceived tactilely and/or visually, and/or, a mark that allows an amount of the hair treating agent supplied to the tube to be adjusted to a given amount are/is provided as the leak-prevention mark.

DETAILED DESCRIPTION OF THE INVENTION

The following describes the present invention according to preferred embodiments thereof.

Figure 1:
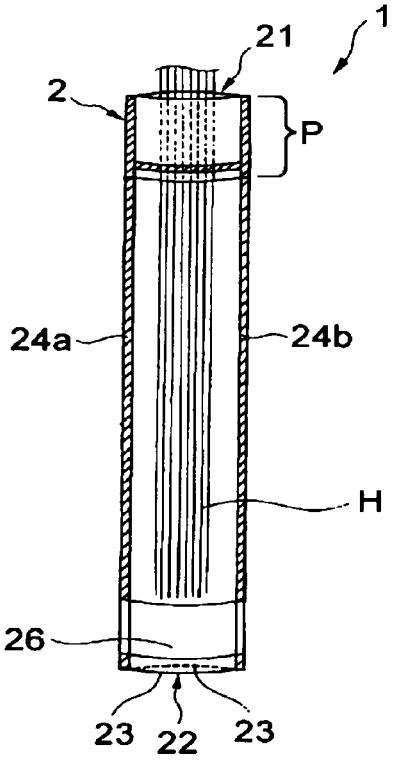
FIG. 1 is a perspective showing a hair holder according to an embodiment of the present invention (a first aspect of the invention).
Figure 2A:
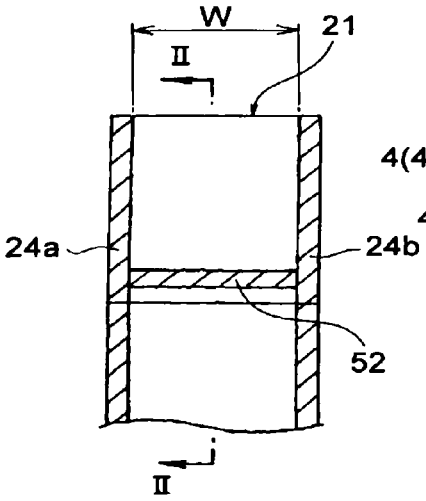
FIGS. 2(*a*) to 2(*c*) are partially enlarged diagrams showing in enlargement the vicinity of an opening at one end of the hair holder of FIG. 1, wherein FIG. 2(*a*) is a front view thereof, FIG. 2(*b*) is a cross-sectional view taken along line II-II of FIG. 2(*a*) with the one-end opening in its closed state, and FIG. 2(*c*) is a cross-sectional view taken along line II-II of FIG. 2(*a*) with the one-end opening in its opened state.
Figure 2B:
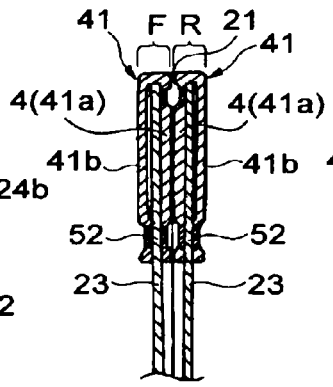
Figure 2C:
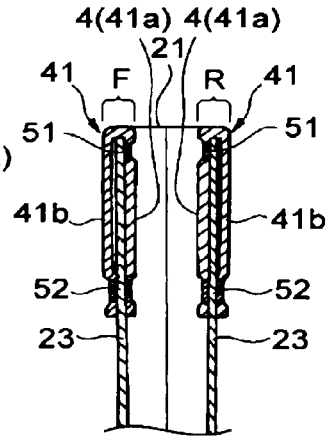
Figure 3:
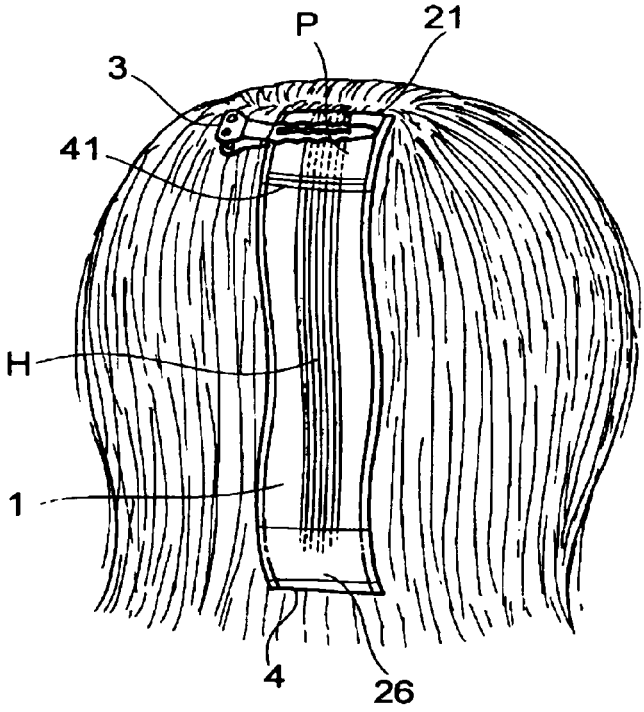
FIG. 3 is a perspective showing a state in which the hair holder of FIG. 1 is fixed to a hair bundle.

As shown in FIGS. 1 to 3, a hair holder 1 according to an embodiment of the present invention (a first aspect of the invention) has a tube 2 that is formed of sheets 23 and 23 and so designed that a hair bundle H can be inserted from an opening 21 at one end toward an opening 22 at the other end. The hair holder 1 is designed so that a dyeing agent can be supplied into the tube 2 as a hair treating agent and the hair bundle H can be subjected to dyeing treatment inside the tube 2. Note that "dyeing agents" as used in the present invention also include bleaching agents in addition to dyeing agents.

Figure 4:
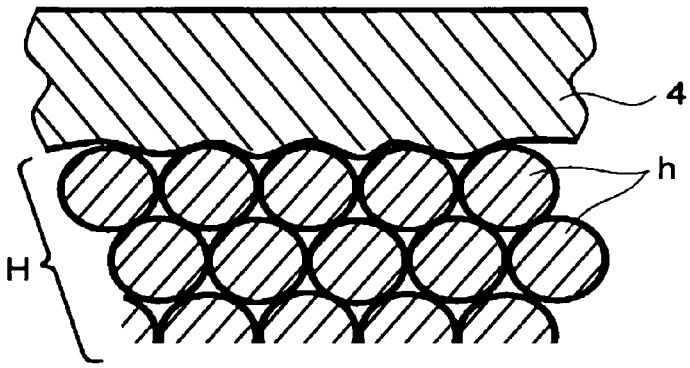
FIG. 4 is a schematic cross-sectional view showing a typical example of how a hair-treating-agent leak-prevention member deforms to conform to the projecting-and-depressed shape of the surface of the hair bundle H.

The tube 2 has, on its inner-surface side in the vicinity of the one-end opening 21, hair-treating-agent leak-prevention members 4 and 4 that can deform to conform to the projecting-and-depressed shape of the surface of the hair bundle H when pressed thereagainst. FIG. 4 shows a typical example of how the hair-treating-agent leak-prevention member 4 deforms to conform to the projecting-and-depressed shape of the surface of the hair bundle H. In FIG. 4, the symbol "h" indicates a cross section of each piece of hair.

The hair holder 1 is described in detail below.

As shown in FIG. 1, the tube 2 is long in its length direction and is so structured that the hair bundle H can be inserted from the one-end opening 21 toward the other-end opening 22. The tube 2 is formed of a pair of rectangular sheets 23 and 23 that are long in their length directions. The pair of sheets 23 and 23 is made into a flat tube by joining their corresponding side ends together at the lengthwise side ends 24*a* and 24*b* of the tube 2. Each sheet, of the pair of sheets 23 and 23, is soft and thus the tube 2 is flexible.

The length of the tube 2 is set appropriately depending on the length of the hair to be treated, and is preferably longer than the length of the hair to be treated. Each opening 21, 22 of the tube 2 has a narrow elliptic shape in its natural state, and its size is set appropriately depending on the amount of the hair bundle to be inserted.

Generally, the tube 2 has a length of approximately 50 to 600 mm. As regards the size of the openings 21 and 22, a distance W from one side end 24*a* of the tube 2 to the other side end 24*b* thereof (see FIG. 2(*a*)) is approximately 5 to 100 mm; this distance W is measured in a state where one side F (the front side, or hereinafter the "first side F") and the opposing other side R (the rear side, or hereinafter the "second side R") of the tube 2 are arranged in close contact with one another. The distance W is equal to half the circumferential length of the inner surface of each opening 21, 22.

The pair of sheets 23 and 23 is made of a material impermeable to dyeing agents, and therefore, no dyeing agent leaks out from the side surfaces of the tube 2. This prevents hair other than the hair bundle inserted in the hair holder 1 from being dyed. Accordingly, the dyeing treatment using the hair holder 1 of the present embodiment is suitable for partially dyeing the hair on one's head.

The dyeing agent exists in the hair holder 1 in a relatively sealed state. Therefore, in cases where the dyeing agent includes volatile components, such components are prevented from volatilizing during dyeing. Accordingly, the hair holder is advantageous in that the dyeing treatment can be performed efficiently.

Examples of materials preferably used for forming the pair of sheets 23 and 23 include: films manufactured using a single type of synthetic resin, e.g., a polyolefin such as polyethylene and polypropylene, polyester such as polyethylene terephthalate, nylon, polystyrene, and polyvinyl chloride; and synthetic-resin films obtained by laminating multiple layers of the above-mentioned films.

The hair-treating-agent leak-prevention member 4 in the hair holder 1 of the present embodiment is made of a nonwoven fabric.

As shown in FIG. 2(*c*), in the tube 2 according to the present embodiment, each of the first side F and the opposing second side R in the vicinity of the one-end opening 21 is formed of a sheet 23 that is impermeable to dyeing agents and a rectangular nonwoven fabric 41 that is folded into half, laminated onto both the inner and outer surfaces of the sheet 23, and partially joined to the sheet 23.

The hair-treating-agent leak-prevention member 4 in the present embodiment is made of a section 41*a* of the nonwoven fabric 41 located on the inner-surface side of the sheet 23 (i.e., the tube's inner-surface side) (which is referred to hereinbelow also as the "inner-surface-side section 41*a*").

The nonwoven fabric 41 has approximately the same width as the sheet 23. The inner-surface-side section 41*a* of the nonwoven fabric 41, which constitutes the hair-treating-agent leak-prevention member 4, is joined to the sheet 23 through heat sealing at a portion—which is indicated by the symbol 51 in FIG. 2(*c*)—close to one end of the section 41*a* on the side of the edge of the opening 21 and a portion 52—which is indicated by the symbol 52 in FIG. 2(*c*)—close to the other end of the section 41*a*. Both side ends of the inner-surface-side section 41*a* of the nonwoven fabric 41 are joined through heat sealing between the sheets 23 and 23 at the side ends 24*a* and 24*b* of the tube 2. A section 41*b* of the nonwoven fabric 41 located on the outer-surface side of the sheet 23 (which is referred to hereinbelow also as the "outer-surface-side section 41*b*") is joined to the sheet 23 through heat sealing at the above-mentioned portion indicated by the symbol 52 and at the side ends 24*a* and 24*b* of the tube 2.

As shown in FIG. 3, the hair holder 1 of the present embodiment is used in a state where: the hair bundle H is inserted from the one-end opening 21 of the tube 2; a section P of the tube 2 where the hair-treating-agent leak-prevention members 4 and 4 are provided is pinched in this inserted state with a fixing member such as a clip-type fixing member 3; and the hair holder is thereby fixed to the hair bundle H. The hair-treating-agent leak-prevention members 4 are pressed against the hair bundle H from both sides thereof when the hair holder is fixed with the fixing member. Since each hair-treating-agent leak-prevention member 4 is made of a nonwoven fabric, the surface thereof that is pressed against the hair bundle deforms to conform to the projecting-and-depressed shape of the surface of the hair bundle, as shown in FIG. 4. More specifically, each leak-prevention member deforms to conform to shape of the fine projections and depressions formed on the surface of the hair bundle by the pieces of hair making up the hair bundle.

Thus, a large frictional resistance is produced between the hair-treating-agent leak-prevention member 4 and the hair bundle H. As a result, the tube 2 fixed to the hair bundle H becomes less prone to falling off, thereby achieving stable fixing of the tube 2 to the hair bundle H.

Also, providing the hair-treating-agent leak-prevention members 4 in the vicinity of the opening 21 effectively prevents the dyeing agent from leaking out from the one-end opening 21 when the dyeing agent is supplied from the other-end opening 22 of the tube 2 with the hair holder 1 being fixed to the hair bundle H and the supplied dyeing agent is spread and applied by stroking the tube 2 with the fingers of the hand in a direction from the other-end opening 22 to the one-end opening 21, for example.

From the viewpoint of allowing the surface of the hair-treating-agent leak-prevention member 4 in contact with the hair bundle H to deform to conform to the surface shape of the hair bundle H having fine projections and depressions, it is preferable that the difference in thickness (T1−T2) between a thickness T1 of the member 4 at a load of 3.7 g/cm$^2$ and a thickness T2 of the member 4 at a load of 204 g/cm$^2$ is equal to or more than 0.05 mm, this value being half of 0.1 mm which is the typical thickness of a piece of hair. It is more preferable that the thickness difference is 0.1 to 0.5 mm. Also, from the same viewpoint and from the viewpoint of cost and productivity, the thickness T1 is preferably 0.3 to 2 mm, and more preferably, 0.4 to 1 mm.

The load value of 3.7 g/cm$^2$ presents a measurement condition under a light load, and is a load defined for measuring the thickness of a soft object stably.

The load value of 204 g/cm$^2$ presents a measurement condition under a high load, and is a load serving as a guide for achieving a preferred fixing force for fixing the hair holder to the hair bundle without it falling off.

Setting the difference in thickness (T1−T2) to a value equal to or more than half of 0.1 mm, which is the typical thickness of a piece of hair, allows one hair-treating-agent leak-prevention member and an opposing hair-treating-agent leak-prevention member (for example, the member on the "R" side corresponding to the member on the "F" side in FIG. 2(*c*)) to surround the outer circumference of the hair, thus preventing the dyeing agent from leaking. In practice, the hair-treating-agent leak-prevention members do not have to be able to completely surround the outer circumference of the hair due, for example, to dishevelment of the hair bundle, and it is sufficient that the relationship between the viscosity of the dyeing agent and the gap existing between the hair and the hair-treating-agent leak-prevention members meets a condition that no dyeing agent leaks when stroking the hair holder.

The thicknesses T1 and T2 are measured as follows:

A test piece approximately 3×3 cm in size is cut out from the hair-treating-agent leak-prevention member 4. Using a dial gauge having a flat tip, the thickness of the test piece is measured at the loads 3.7 g/cm$^2$ and 204 g/cm$^2$.

Further, as in the present embodiment, the hair-treating-agent leak-prevention member 4 is preferably made of a porous material capable of being impregnated with and holding a hair treating agent, and particularly a dyeing agent. Using a porous material capable of being impregnated with and holding a hair treating agent allows any excess hair treating agent to be held in the porous material, thereby achieving the effect of reducing leaks.

Note that "porous materials" as used in the present application refer to materials having a structure causing capillarity, and include fibrous materials such as nonwoven fabrics as exemplified below, as well as sponge-like materials, etc.

Other than the nonwoven fabric as used in the present embodiment, it is possible to use, for example, a sponge made of polyvinyl alcohol, polyethylene, polyurethane, or synthetic-rubber materials, as the porous material capable of being impregnated with and holding a dyeing agent (hair treating agent). Among these, nonwoven fabric is preferable. Nonwoven fabrics made by various manufacturing methods can be used as the nonwoven fabric, and it is possible to use, for example, air-through nonwoven fabrics, spunlace nonwoven fabrics, air-laid nonwoven fabrics, meltblown nonwoven fabrics, or spunbond nonwoven fabrics. Among these nonwoven fabrics, spunlace-, air-through-, and spunbond nonwovens are preferably used, in terms of conformability and deformability to the transverse cross-sectional shape of the hair bundle H.

Cellulosic fibers, modified cellulose fibers, or synthetic fibers, or a mixture including at least two of the above can be used as the fibrous material constituting the nonwoven fabric. Examples of cellulosic fibers include natural fibers such as wood-based pulp, cotton, and hemp, and cellulosic chemical fibers such as Tencel, viscose rayon, and acetate. Examples of synthetic fibers include polyethylene-based fibers, polypropylene-based fibers, polyester-based fibers, polyamide-based fibers, polyacrylonitrile-based fibers, polyvinyl alcohol-based fibers, conjugate fibers having at least two of the above synthetic fibers conjugated into a sheath/core structure etc., and mixed fibers having at least two of the above synthetic fibers mixed together.

Further, it is preferable that the hair-treating-agent leak-prevention member 4 has elastic returnability to compression in the thickness direction.

The hair holder 1 of the present embodiment is preferably used in combination with a fixing member capable of pinching the section P of the tube 2 where the hair-treating-agent leak-prevention members 4 and 4 are provided. A clip-type fixing member is preferably used as such a fixing member.

Figure 5:
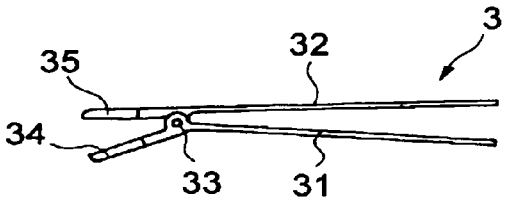
FIG. 5 is a schematic diagram showing a preferred example of a fixing member usable in the present invention.

As regards the clip-type fixing member 3, a pair of pinchers 31 and 32 is coupled together at one end thereof, and the fixing member 3 can be fixed to the hair bundle by pinching the hair bundle between the pair of pinchers 31 and 32, as in the clip-type fixing member 3 shown, for example, in FIG. 5.

The clip-type fixing member 3 shown in FIG. 5 is so designed that the pair of pinchers 31 and 32 is pivotally coupled about a pivot 33 and a spring (not shown) provided on the pivot 33 urges the fixing member in a direction in which the paired pinchers 31 and 32 close up. The so-designed clip-type fixing member 3 allows opening/closing of the pair of pinchers 31 and 32 through an easy operation, i.e., by gripping/releasing, with the hand, grips 34 and 35 formed continuously on the respective paired pinchers 31 and 32 at the above-mentioned one end thereof.

It is also possible to use a clip-type fixing member having no grip 34, 35. For example, it is possible to use a fixing member made of a pair of metal pinchers 31 and 32 each having spring-like elasticity and being placed upon one another and joined together at one end. With this fixing member, the paired pinchers 31 and 32 can be opened by being bent together in one direction and closed by being bent in the other direction.

Figure 6A:
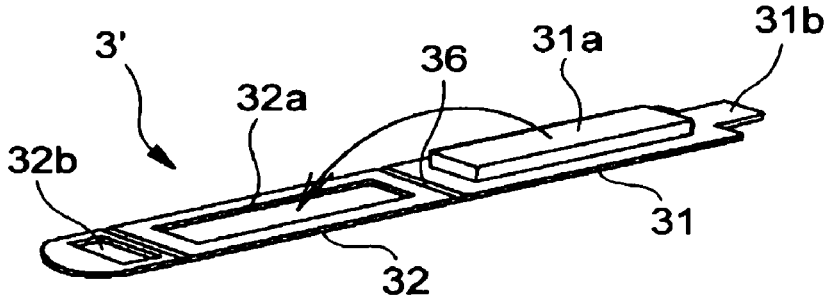
FIGS. 6(*a*) and 6(*b*) are diagrams showing another preferred example of a fixing member usable in the present invention (first aspect of the invention), wherein FIG. 6(*a*) is a diagram showing an extended state in which a pair of pinchers is opened up and FIG. 6(*b*) is a diagram showing a fixed state in which the pair of pinchers is closed and their mating sections mate with one another.
Figure 6B:
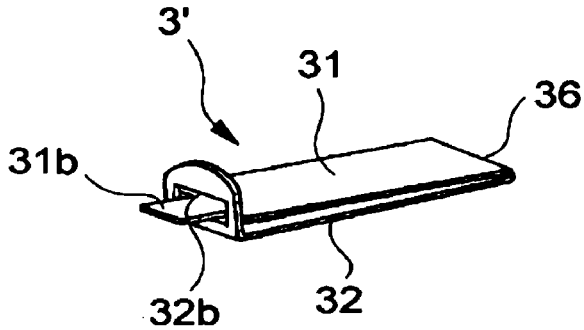

It is also possible to use a clip-type fixing member 3' of the type shown in FIGS. 6(*a*) and 6(*b*) as the clip-type fixing member. The clip-type fixing member 3' is made of a synthetic resin, and is so structured that a pair of pinchers 31 and 32 is coupled together via a hinge section 36. This clip-type fixing member 3' has an opening 32*a* or a depression in one pincher 32, and a projection 31*a* in the other pincher 31 for pressing an object pinched between the pinchers 31 and 32 into the opening 32*a* or depression. The opening 32*a* or depression of the clip-type fixing member 3' shown in FIGS. 6(*a*) and 6(*b*) has a rectangular shape that is long in the length direction of the pincher 32, and the projection 31*a* has a dimension slightly smaller than that of the opening 32*a* or depression.

The clip-type fixing member 3' can be used in such a manner that it pinches the section P of the hair holder 1 having the hair-treating-agent leak-prevention members 4 and 4 between the pair of pinchers 31 and 32 and maintains this state with a lock mechanism 31*b* and 32*b* provided on the opposite side from the hinge section 36.

Materials similar to those of various conventionally-known hairclips can be used for forming the fixing member such as the clip-type fixing member 3; preferable materials are those that do not cause chemical reactions, in particular, corrosion, discoloration, etc. to dyeing agents. Such materials preferably include, for example, synthetic resin materials such as polypropylene, polyacetal, and polyethylene. Even materials that cause chemical reactions, such as corrosion and discoloration, to dyeing agents can preferably be used if their surfaces are covered, for example, with a metal or a resin chemically inert to dyeing agents.

In terms of fixing the hair holder and preventing the dyeing agent from leaking, it is preferable that the fixing member used in this aspect of the invention pinches the tube 2 and sufficiently presses the hair-treating-agent leak-prevention members 4 provided on the tube 2 against the hair bundle H. From this viewpoint, it is preferable that the fixing member is capable of applying a fixing force of 0.4 N or more, and more preferably a fixing force of from 0.5 to 3.0 N.

The "fixing force" as used herein is measured as follows:

An LDPE (low-density polyethylene) film 30 mm×200 mm large and 80 μm thick is pinched between a fixing member. The maximum load for when the film, in this pinched state, is pulled off from the fixing member in the length direction is adopted as the fixing force. A push-pull gauge (available from Imada Co., Ltd.) is used for the measurement.

From the viewpoint of securely fixing the tube to the hair bundle and preventing dyeing agents etc. from leaking out from the opening 21, the length of each of the pair of pinchers 31 and 32 of the clip-type fixing member 3, which is used together with the tube 2, is preferably 100% or more of the distance W, and more preferably from 100% to 150% of the distance W, between both side edges 24*a* and 24*b* of the tube 2.

The section for providing the hair-treating-agent leak-prevention member 4 is on the inner-surface side in the vicinity of the one-end opening. The distance from the edge of the one-end opening 21 to the hair-treating-agent leak-prevention member 4 in the length direction of the tube 2 is preferably 0 to 50 mm, and more preferably 0 to 30 mm, and even more preferably 0 to 10 mm. The distance from the edge of the opening to the farthest section of the hair-treating-agent leak-prevention member 4 is preferably 5 to 110 mm, and more preferably 20 to 60 mm.

The length of the hair-treating-agent leak-prevention member 4 in the length direction is preferably approximately 5 to 60 mm, and more preferably approximately 20 to 40 mm.

The hair holder 1 of the present embodiment is described in further detail. An openable/closable sealing means 26 is provided in the vicinity of the other-end opening 22 of the tube 2 for preventing the dyeing agent supplied inside the tube 2 from flowing out from the other-end opening 22.

The sealing means 26 in the present embodiment is a sheet-like member that allows plastic deformation and that can maintain its deformed shape, and is joined to the outer surface of the sheet 23 forming the first side F of the tube 2. For example, a metal sheet such as an aluminum foil is preferably used as the sheet-like member. The opening 22 of the tube 2 can openably/closably be sealed by folding the section of the tube 2 having the sheet-like member 26 upward once or several times.

A zipper, for example, can be used as another sealing means capable of openably/closably sealing the opening 22. Providing a zipper allows the other-end opening 22 to be opened and closed. It is also possible to use, for example, a mechanical hook-and-loop fastener, an adhesive tape, or a self-adhesive tape (for example, "Fushigi Tape" (trade name) available from Nirei Industry Co., Ltd.) as the sealing means.

In the hair holder 1 of the present embodiment, it is also preferable to use a hair inserter upon dyeing treatment for inserting a hair bundle H from the one-end opening 21 into the tube 2. A preferable hair inserter has a latch-hook at one end in the length direction thereof for hooking a hair bundle H and a grip at the other end, and is inserted into the tube in advance or upon use, so that when in use, the latch-hook extends outward from the tube's one-end opening and the grip extends outward from the tube's other-end opening. The specifications etc. of JP2003-93133 A and US2004/216759 A1 mentioned above disclose examples of such a hair inserter.

The following describes an example of dyeing treatment using the above-described hair holder 1 and the preferable hair inserter. In terms of dyeing the entire hair bundle H, it is preferable that the length of the tube 2 of the hair holder 1 used for dyeing is longer than the length of the hair bundle H.

The hair holder 1 is prepared with the latch-hook of the hair inserter extending outward from the one-end opening 21 and the grip extending outward from the other-end opening 22.

The hair bundle H is then hooked into the hair inserter's latch-hook. In doing so, it is preferable to hook, into the latch-hook, a portion of the hair bundle H close to the scalp. Then, the grip is pulled with the latch-hook engaged to the hair bundle H, and this inserts the hair bundle H into the tube 2. The hair bundle H is brought into a generally linear, straightened state inside the tube 2, as shown in FIG. 3.

After confirming that the opening 21 of the tube 2 is in an appropriate position on the hair bundle H, the tube 2 is fixed to the hair bundle H by pinching the section of the tube 2 where the hair-treating-agent leak-prevention members 4 are provided using the clip-type fixing member 3.

Figure 7A:
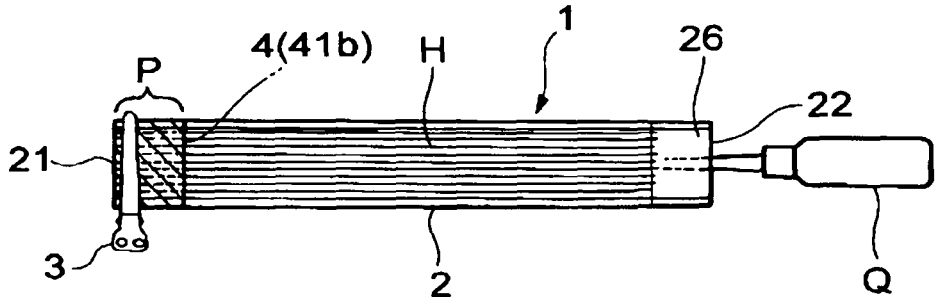
FIGS. 7(*a*) to 7(*c*) are schematic diagrams schematically showing how coloring treatment is applied using the hair holder of FIG. 1, wherein FIG. 7(*a*) is a diagram showing how a dyeing agent is supplied to the hair holder, FIG. 7(*b*) is a diagram showing a state before stroking the hair holder, and FIG. 7(*c*) is a diagram showing how the tube is stroked to spread and apply the dyeing agent.
Figure 7B:
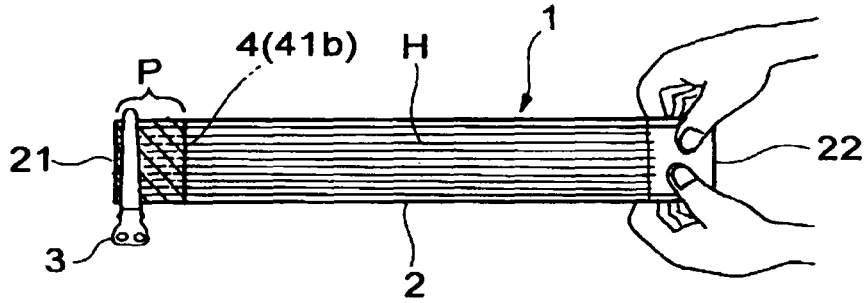
Figure 7C:
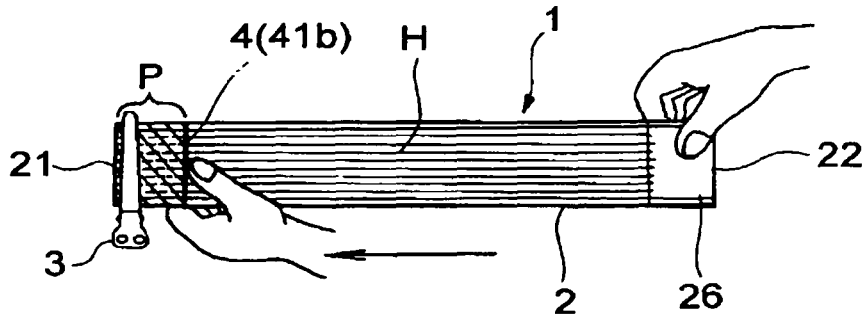

Then, as shown in FIG. 7(*a*), in this state where the hair holder 1 is fixed to the hair bundle H, a prescribed amount of liquid dyeing agent is supplied into the tube 2 from the other-end opening 22 thereof using, for example, a dyeing-agent container Q containing the dyeing agent. Next, as shown in FIG. 7(*b*), the user holds the vicinity of the other-end opening 22 of the hair holder 1 with both hands. Then, as shown in FIG. 7(*c*), while holding the vicinity with one hand, the user strokes the tube 2 from both sides with the fingers of the other hand from the other-end opening 22 toward the one-end opening 21, to spread and apply the dyeing agent onto the hair bundle H. The other-end opening 22 is sealed using the sealing means 26 if necessary.

After repeating the same operation using a plurality of hair holders if desired, the hair holders are left as they are for a prescribed amount of time.

After this time, the clip-type fixing member 3 is removed from the tube 2 and the hair bundle H is removed from the hair holder 1. The hair is then rinsed, and if desired, is also shampooed and blow-dried.

Figure 8:
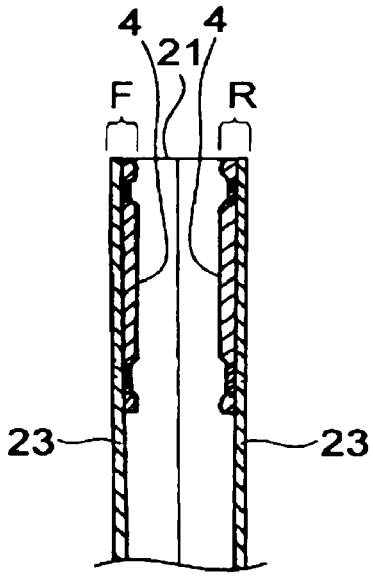
FIG. 8 is a schematic diagram (corresponding to FIG. 2(*c*)) showing a primary part of another embodiment of the present invention (first aspect of the invention).

FIG. 8 is a diagram showing another embodiment of a hair holder according to the first aspect of the invention. The hair holder shown in FIG. 8 has the hair-treating-agent leak-prevention members 4 provided only on the inner-surface side of the tube 2 in the vicinity of the one-end opening 21 thereof. The hair holder shown in FIG. 8 also achieves the same effects as those of the hair holder 1 described above. Features of the hair holder shown in FIG. 8 not particularly explained are the same as those of the hair holder 1 described above.

The hair holder of the first aspect of the invention is not limited to the foregoing embodiments, and can be modified as appropriate as long as it does not depart from the spirit and scope of the first aspect of the invention.

Figure 9:
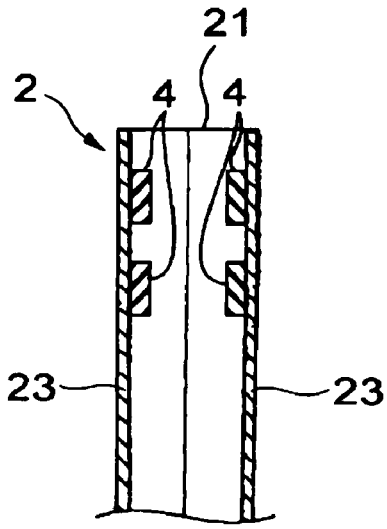
FIG. 9 is a schematic diagram (corresponding to FIG. 2(*c*)) showing a primary part of still another embodiment of the present invention (first aspect of the invention).

For example, instead of providing the hair-treating-agent leak-prevention members 4 respectively on the opposing first and second sides F and R of the tube 2, the hair-treating-agent leak-prevention member 4 may be provided only on one of the sides. Also, as shown in FIG. 9, each of the opposing first and second sides F and R may have a plurality of hair-treating-agent leak-prevention members 4 and 4 spaced apart from one another in the length direction of the tube 2. The hair-treating-agent leak-prevention member may also be made of an elastic material such as natural rubber and synthetic rubber. Ultrasonic sealing, impulse sealing, adhesives, or double-faced adhesive tapes, for example, may be employed for fixing the hair-treating-agent leak-prevention member 4 to the sheet 23 instead of heat sealing.

Permanent straightening is also preferably carried out using the hair holder of the first aspect of the invention. For example, in performing the permanent-straightening treatment, it is necessary to apply a permanent treatment solution to the hair as the hair treating agent. In this case, it is preferable to use a material permeable to the permanent treatment solution for one or both of the pair of sheets 23 and 23 forming the tube 2. A hair bundle H to be subjected to the permanent treatment is held in the hair holder 1, and the permanent treatment solution is supplied from the outside of the hair holder 1 and applied to the hair bundle by permeating the sheet(s). This allows the permanent treatment to be done efficiently.

Next, a hair holder 101 according to a first embodiment of a second aspect of the invention is described with reference to the drawings. The hair holder 101 has, as a leak-prevention mark for preventing a hair treating agent from leaking out from a tube 102, a section indicating an endpoint of a range for stroking the tube 102 in such a manner that the endpoint can be perceived tactilely and/or visually.

Figure 10:
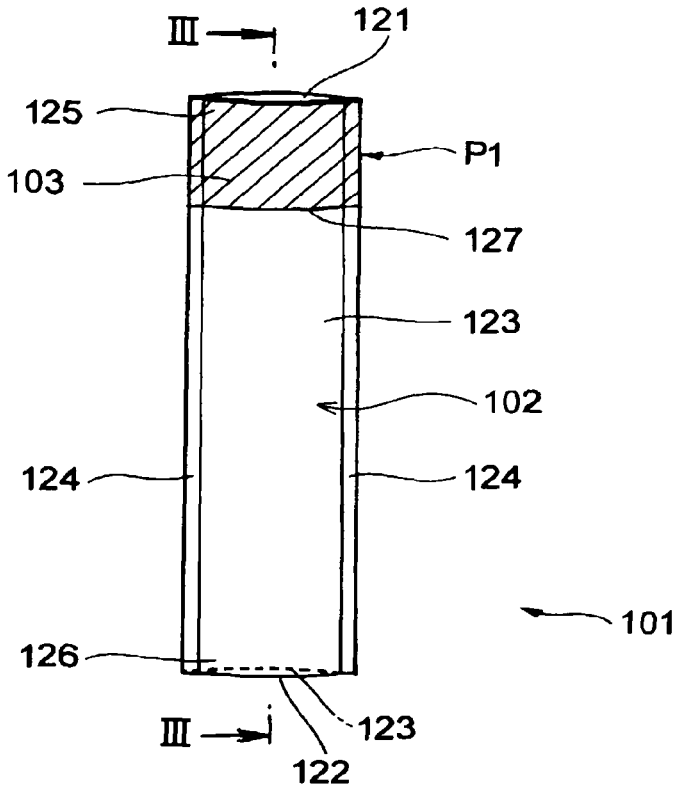
FIG. 10 is a perspective showing a first embodiment of a hair holder according to a second aspect of the invention.
Figure 11:
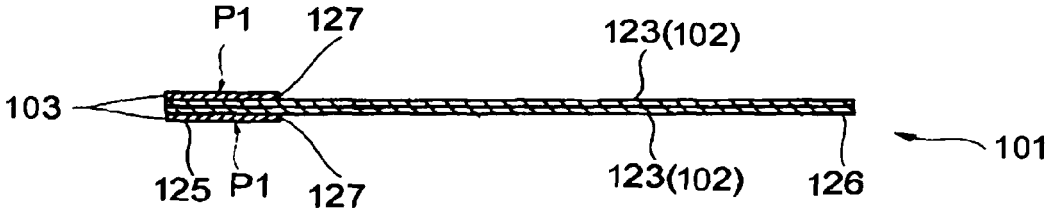
FIG. 11 is a cross-sectional view taken along line III-III of FIG. 10.
Figure 12A:
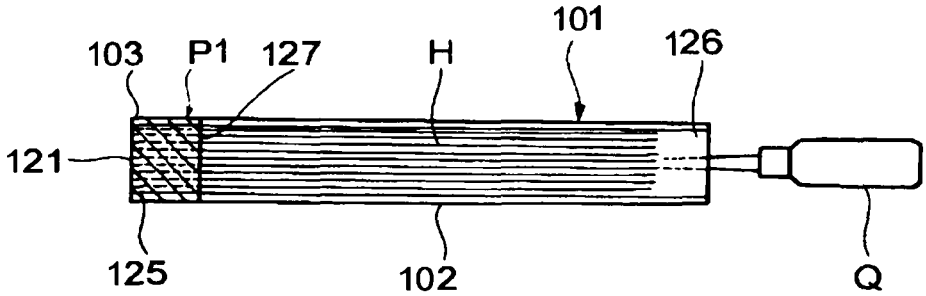
FIGS. 12(*a*) to 12(*c*) are schematic diagrams showing how the hair holder of FIG. 10 is stroked to spread and apply a dyeing agent onto a hair bundle, wherein FIG. 12(*a*) shows how the dyeing agent is supplied to the hair holder, FIG. 12(*b*) shows a state before stroking the hair holder, and FIG. 12(*c*) shows how the hair holder is stroked.
Figure 12B:
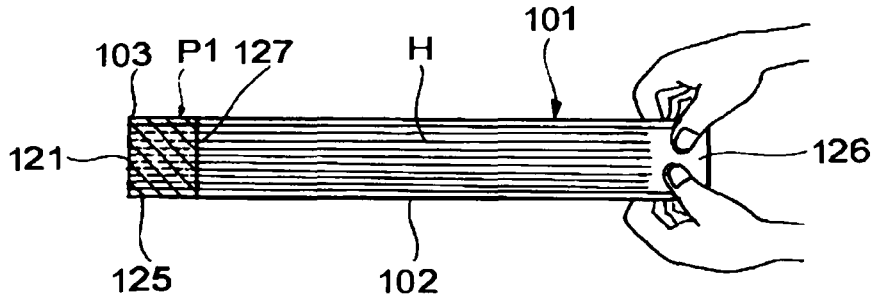
Figure 12C:
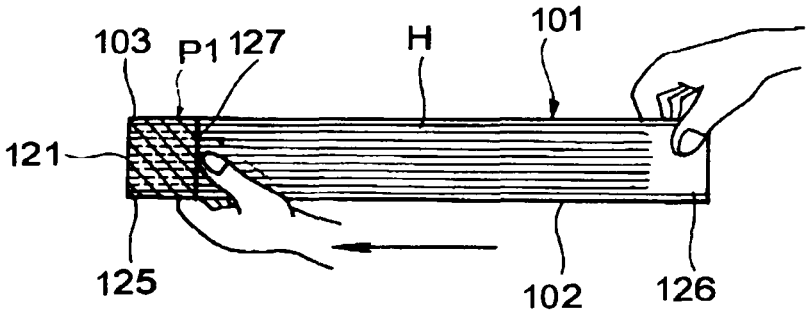

As shown in FIGS. 10 to 12, the hair holder 101 according to the first embodiment of the second aspect of the invention is made of a tube 102 that is formed of a pair of sheets 123 and 123 and so designed that a hair bundle H can be inserted from an opening 121 at one end toward an opening 122 at the other end. The hair holder 101 is so structured that a dyeing agent, which serves as a hair treating agent, supplied to the tube 102 can be spread and applied onto the hair bundle H having been inserted into the tube 102 from the one-end opening 121 by stroking the tube 102 from the side of the other-end opening 122 toward the one-end opening 121, and is used for dyeing the hair bundle H.

Further, in order to prevent the dyeing agent from leaking from the one-end opening 121, the hair holder 101 of the present embodiment is made so that an endpoint 127 of a range for stroking the tube 102 can be perceived tactilely and visually.

The hair holder 101 of the present embodiment is described in detail below.

As shown in FIG. 10, the tube 102 is long in its length direction and is so structured that the hair bundle H can be inserted from the one-end opening 121 toward the other-end opening 122. The tube 102 is formed by joining a pair of long rectangular sheets 123 and 123 together at the lengthwise side ends 124 and 124. The pair of sheets 123 and 123 is soft and thus the tube 102 is flexible.

The length of the tube 102 is set appropriately depending on the length of the hair to be treated, and is preferably longer than the length of the hair to be treated. Each opening 121, 122 of the tube 102 has an elliptic or circular shape, and its size is set appropriately depending on the amount of the hair bundle to be inserted.

Generally, the length of the tube 102 ranges approximately from 50 to 600 mm, and the size of each opening 121, 122 ranges approximately from 5 to 100 mm in major diameter and approximately from 2 to 40 mm in minor diameter. The openings 121 and 122 of the tube 102 are circular when the major diameter is equal to the minor diameter.

As shown in FIGS. 12(*a*) to 12(*c*), the hair holder 101 is preferably used for subjecting the hair bundle H to dyeing treatment inside the tube 102 by spreading and applying the dyeing agent supplied to the tube 102 onto the hair bundle H having been inserted into the tube 102 from the one-end opening 121 through stroking of the tube 102 from the side of the other-end opening 122 toward the one-end opening 121. In carrying out the dyeing treatment, it is preferable to position the side of an upper end 125 having the one-end opening 121 up and the side of a lower end 126 having the other-end opening 122 down, with respect to the length direction of the tube 102.

The pair of sheets 123 and 123 is made of a material impermeable to dyeing agents, and therefore, no dyeing agent leaks out from the side surfaces of the tube 102. This prevents hair other than the hair bundle inserted in the hair holder 101 from being dyed. Accordingly, the dyeing treatment using the hair holder 101 of the present embodiment is particularly effective in partially dyeing the hair on one's head.

The dyeing agent exists in the hair holder 101 in a relatively sealed state. Therefore, in cases where the dyeing agent includes volatile components, such components are prevented from volatilizing during dyeing. Accordingly, the hair holder 101 is advantageous in that the dyeing treatment can be performed efficiently.

Examples of materials preferably used for forming the pair of sheets 123 and 123 include: films manufactured using a single type of synthetic resin, e.g., a polyolefin such as polyethylene and polypropylene, polyester such as polyethylene terephthalate, nylon, polystyrene, and polyvinyl chloride; films manufactured using blends of the above-mentioned synthetic resins; and synthetic-resin films obtained by laminating multiple layers of the above-mentioned films.

The hair holder 101 of the present embodiment has a stepped section on the tube 102 indicating the endpoint 127. Note here that the term "vicinity" as used in the present description means "an extent close enough so as to allow a desired length of the hair bundle H to be dyed while preventing the dyeing agent from leaking from the tube 102", and such an extent can be set as appropriate depending on the length of hair to be dyed and the amount of dyeing agent supplied to the tube 102. As shown in FIG. 11, the stepped section is stepped in the thickness direction of the tube 102. The stepped section, which serves as the section of the tube 102 indicating the endpoint 127, is provided in the vicinity of the one-end opening 121 as shown in FIGS. 11 and 12, and is formed thicker than the other sections of the tube.

As the user strokes the tube 102 from the side of the other-end opening 122 toward the one-end opening 121 with the fingers, the fingers abut against the stepped section, i.e., the section indicating the endpoint 127. This prevents stroking of the tube 102 beyond this point. This stepped section, i.e., the section indicating the endpoint 127 can also be perceived visually.

Specifically, in the vicinity of the one-end opening 121 of the tube 102, each of a pair of rectangular sheet pieces 103 and 103 is joined to the outer surface of each sheet 123 in the upper end 125 of the tube 102, and the vicinity of the one-end opening is thus formed thicker than the other sections of the tube 102. The stepped section is formed in a section of the edge of the sheet piece 103 on the side of the lower end 126.

Describing this more specifically, the section indicating the endpoint 127 includes not only the stepped section but also the planar section of the sheet piece 103. Since the section to which the sheet piece 103 is joined is thicker than the other sections of the tube 102, the planar section of the sheet piece 103 is also perceived, tactilely and visually, as the section indicating the endpoint 127.

Each sheet piece 103 is rectangular, and in terms of allowing clear tactile perception of the section indicating the endpoint 127 of the range for stroking the tube 102, the thickness thereof is preferably 0.1 to 5 mm, and more preferably 0.5 to 2 mm.

The width of the sheet piece 103 is approximately the same as that of the tube 102. In terms of preventing the dyeing agent from leaking from the one-end opening 121, the length of the sheet piece 103 in the length direction of the tube 102 is preferably 5 to 100 mm, and more preferably 10 to 40 mm. One side of the sheet piece 103 is arranged in alignment with the edge of the tube 102 on the side of the upper end 125.

Further, in the hair holder 101 of the present embodiment, the sheet piece 103 that forms the section indicating the endpoint 127 may be colored to have a different color from that of the other sections of the tube 102. Coloring the section of the tube 102 indicating the endpoint 127 to a color different from that of the other sections allows the section indicating the endpoint 127 of the range for stroking the tube 102 to be visually perceived more easily.

The tube 102 in the hair holder 101 of the present embodiment is formed of a pair of transparent and colorless sheets 123 and 123. The sheet piece 103 may be colored so that it is transparent and colored. However, in terms of allowing the section indicating the endpoint 127 to be visually perceived even more easily, it is preferable that the section is colored so that it is opaque or semitransparent.

Further, in the hair holder 101 of the present embodiment, the section where the sheet piece 103 is joined to each of the pair of sheets 123 and 123 is reduced in flexibility and thus constitutes a highly-rigid section P1 having a rigidity higher than that of the other sections of the sheet 123.

Accordingly, in the hair holder 101 of the present embodiment, the section indicating the endpoint 127 of the range for stroking the tube 102 can be tactilely perceived even more easily.

In terms of ensuring the high rigidity necessary for the section indicating the endpoint 127 while maintaining the flexibility of the hair holder 101, the Taber stiffness of the highly-rigid section P1 is preferably 0.5 to 10 mN·m, and more preferably 1 to 5 mN·m.

The Taber stiffness of the highly-rigid section P1 is measured according to the method specified in JIS-P8125.

The same material as that of the above-described sheets 123 and 123 may be used for forming the sheet pieces 103. However, from the viewpoint of achieving the above-described rigidity range necessary for the highly-rigid section P1, particularly polystyrene or polyethylene terephthalate, for example, is preferably used therefore.

The hair holder 101 of the present embodiment is described in further detail. In order to prevent dyeing agents supplied inside the tube 102 from flowing out from the other-end opening 122, the lower end 126 of the tube 102 preferably has an openable/closable sealing means.

An example of the sealing means includes a zipper. Providing a zipper on the lower end 126 allows opening/closing of the other-end opening 122. Other than a zipper, it is also possible to use, for example, a hook-and-loop fastener, an adhesive tape, or a self-adhesive tape (for example, "Fushigi Tape" (trade name) available from Nirei Industry Co., Ltd.) as the sealing means.

Further, the above-described sealing means may preferably be made by joining, to the lower end 126, a member that has plasticity, such as an aluminum foil, and that can maintain its folded state. For example, a long rectangular aluminum foil strip having the same width as the tube 102 is joined thereto in such a manner that the edge of the tube on the side of the lower end 126 is aligned with the edge of the aluminum foil strip. The section of the lower end 126 having the aluminum foil strip is folded toward the upper end 125 once or several times to thereby seal the lower end of the tube 102.

In the hair holder 101 of the present embodiment, it is also preferable to use a hair inserter upon dyeing treatment for inserting a hair bundle H from the one-end opening 121 into the tube 102. A preferable hair inserter is used in a state inserted inside the hair holder 101 and has a latch-hook at one end for hooking a hair bundle H and a grip at the other end, wherein the latch-hook extends outward from the one-end opening 121 and the grip extends outward from the other-end opening 122. The specifications etc. of JP2003-93133 A and US2004/216759 A1 mentioned above disclose examples of such a hair inserter.

The following describes a usage example of dyeing treatment using the above-described hair holder 101 and the hair inserter. In terms of dyeing the entire hair bundle H, it is preferable that the length of the tube 102 of the hair holder 101 used for dyeing is longer than the length of the hair bundle H.

First, the hair holder 101 is prepared with the latch-hook of the hair inserter extending outward from the one-end opening 121, the grip extending outward from the other-end opening 122, and the hair inserter inserted inside the tube 102.

Next, the hair bundle H is hooked into the hair inserter's latch-hook. In doing so, it is preferable to hook, into the latch-hook, a portion of the hair bundle H close to the scalp. Then, the grip is pulled with the hair bundle H engaged to the latch-hook, and this inserts the hair bundle H into the tube 102. The hair bundle H is brought into a generally linear, straightened state inside the tube 102, as shown in FIG. 12(*a*).

Then, as shown in FIG. 12(*a*), a prescribed amount of liquid dyeing agent is supplied into the tube 102 from the other-end opening 122 thereof using a dyeing-agent container Q containing the dyeing agent. Next, as shown in FIG. 12(*b*), the user holds the lower end 126 of the hair holder 101 with both hands. Then, as shown in FIG. 12(*c*), while holding the lower end 126 with one hand, the user strokes the tube 102 from both sides with the fingers of the other hand from the side of the lower end 126 toward the upper end 125, to spread and apply the dyeing agent onto the hair bundle H.

At the section indicating the endpoint 127 of the hair holder 101, the fingers of the other hand abut against the section indicating the endpoint 127, which prevents stroking of the tube 102 beyond this point. In the hair holder 101 of the present embodiment, the section indicating the endpoint 127 can be perceived both tactilely and visually.

Due to stroking of the tube 102, the dyeing agent inside the tube 102 moves from the side of the lower end 126 toward the upper end 125 while moistening the hair; and the portion of the hair bundle H on the side of the one-end opening 121 beyond the section indicating the endpoint 127 is dyed using a remaining portion of the dyeing agent that has moved by being stroked up to the section indicating the endpoint 127.

As described above, it is preferable that the amount of dyeing agent supplied from the other-end opening 122 of the tube 102 is such that allows the dyeing agent to be applied to the entire hair bundle H inserted inside the tube 102, and at the same time, it is preferable that the amount of the remaining portion of the dyeing agent having moved by being stroked up to the section indicating the endpoint 127 is such that does not leak out from the one-end opening 121.

Also, it is preferable to seal the lower end 126 in cases where the tube 102 has the above-described sealing means.

After repeating the same operation using a plurality of hair holders 101 if desired, the hair holders are left as they are for a prescribed amount of time. After this time, the hair bundle H is removed from the hair holder 101. Preferably, the hair is then rinsed and is also shampooed and blow-dried.

According to the hair holder 101 of the present embodiment described above, the section indicating the endpoint 127 of the range for stroking the tube 102 can be perceived tactilely. Therefore, the dyeing agent will not leak from the tube 102, even when, for example, the user applies the dyeing treatment to his/her hair by himself/herself.

Next, hair holders 101A to 101D according to second to fifth embodiments of the second aspect of the invention are described with reference to FIGS. 13 to 23. The explanation given in detail in the first embodiment of the second aspect of the invention applies as appropriate to features of the second to fifth embodiments not particularly described below. Further, in FIGS. 13 to 23, like components are accompanied with the same symbols as those in FIGS. 10 to 12.

Figure 13:
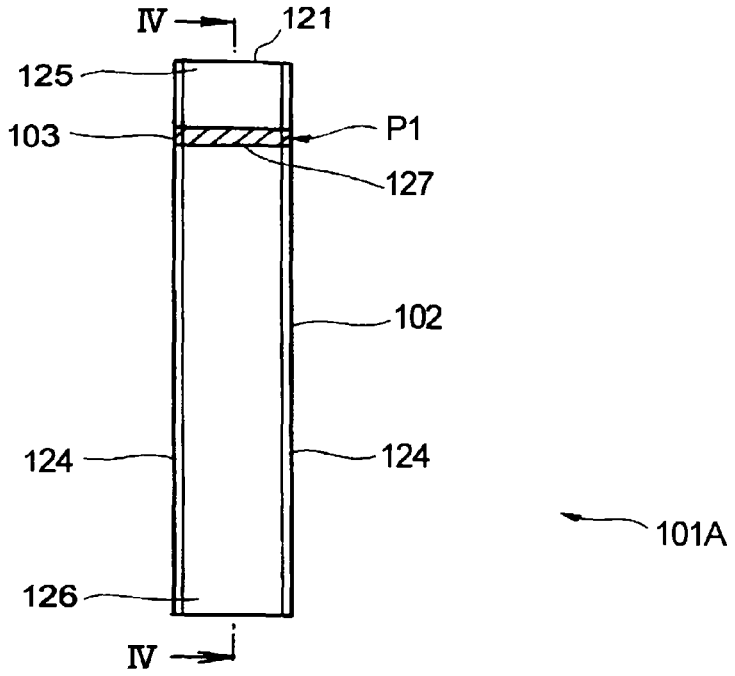
FIG. 13 is a plan view showing a second embodiment of a hair holder according to the second aspect of the invention.
Figure 14:
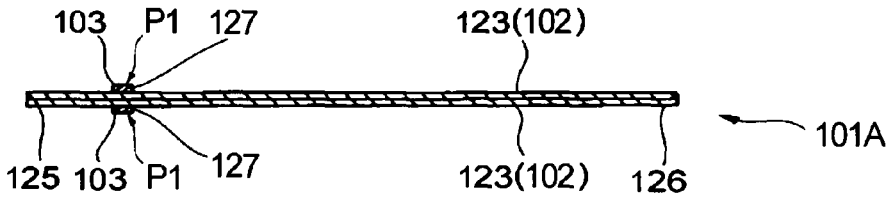
FIG. 14 is a cross-sectional view taken along line IV-IV of FIG. 13.

As shown in FIGS. 13 and 14, in a hair holder 101A of a preferred second embodiment of the second aspect of the invention, the sheet piece 103 is rectangular and long in the lateral direction. The lateral direction of the sheet piece 103 matches the width direction of the tube 102. The length of the sheet piece 103 in the vertical direction is shorter than that of the sheet piece in the hair holder 101 of the above-described first embodiment.

Since the length of the sheet piece 103 in the vertical direction is shorter than that of the sheet piece in the first embodiment, it is preferable that the sheet piece 103 has a thickness equal to or larger than that of the sheet piece in the first embodiment, in terms of allowing clear tactile and visual perception of the section indicating the endpoint 127 of the range for stroking the tube 102. Specifically, the thickness of the sheet piece 103 is preferably within the range of 0.5 to 5 mm.

The length of the sheet piece 103 in the lateral direction is approximately the same as the width of the tube 102. The length of the sheet piece 103 in the vertical direction is preferably within the range of 1 to 10 mm.

In terms of preventing the dyeing agent from leaking from the one-end opening 121, it is preferable that the position for joining the sheet piece 103 to the sheet 123 is located 5 to 100 mm, and more preferably 10 to 40 mm, away from the edge of the tube on the side of the one-end opening 121 toward the lower end 126.

Further, in the hair holder 101A of the present embodiment, the sheet piece 103 that forms the section indicating the endpoint 127 is colored to have a different color from that of the other sections of the tube 102 in order to allow the section indicating the endpoint 127 of the range for stroking the tube 102 to be visually perceived. Further, the section of the hair holder 101A where each of the pair of sheet pieces 103, 103 is joined constitutes a highly-rigid section P1 having a rigidity higher than that of the other sections, because the sheet pieces 103 are joined to the respective sheets 123 and the flexibility in that section is reduced.

Figure 15:
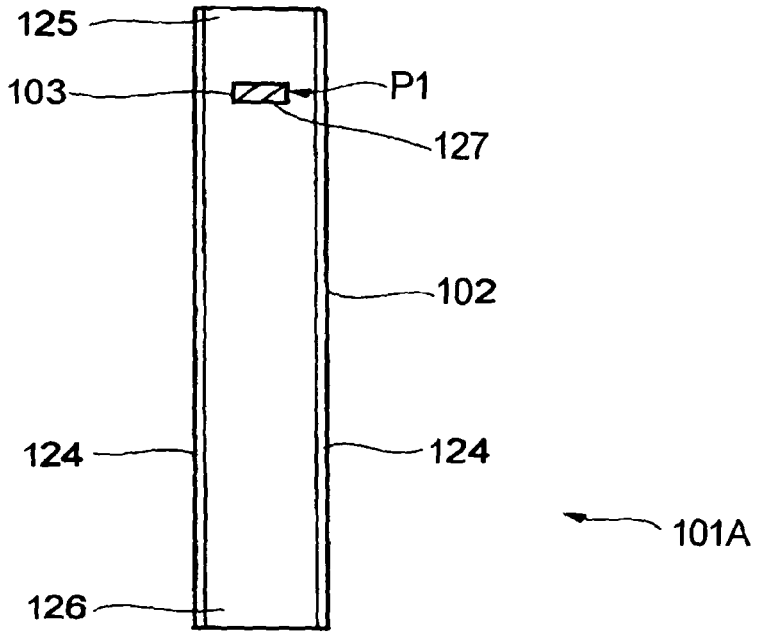
FIG. 15 is a plan view showing a modified example of the second embodiment of the second aspect of the invention.
Figure 16:
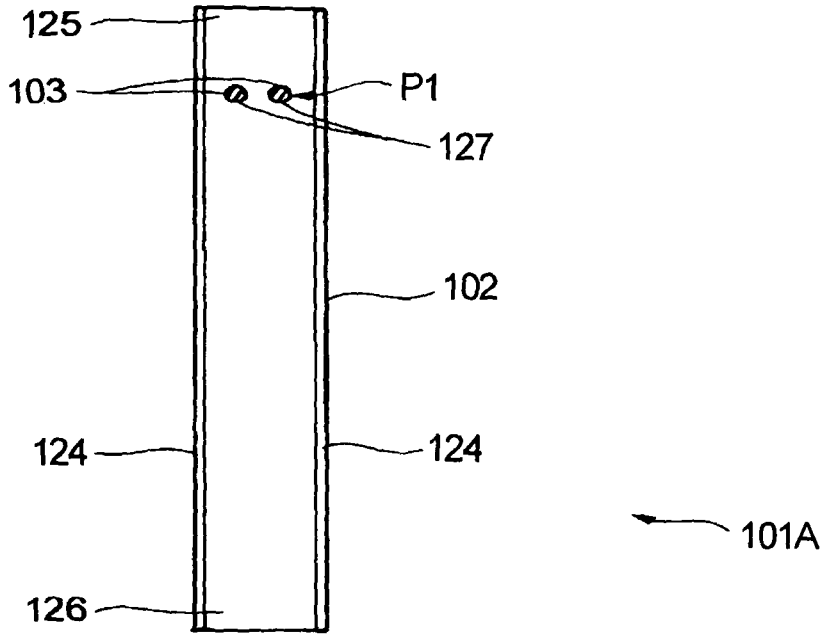
FIG. 16 is a plan view showing another modified example of the second embodiment of the second aspect of the invention.

Also, the lateral width of the sheet piece 103 may be shorter than the width of the sheet 123 as shown in FIG. 15. Further, the endpoint-indicating section may be formed of dots, as in FIG. 16. In cases of FIGS. 15 and 16, the section indicating the endpoint 127 may be formed by applying an adhesive such as hot-melt or a resin to the sheets 123, instead of using the sheet pieces 103.

Figure 17:
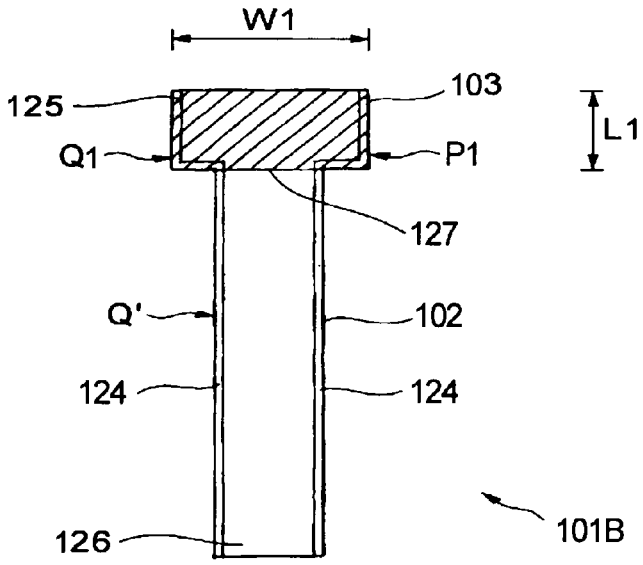
FIG. 17 is a plan view showing a third embodiment of a hair holder according to the second aspect of the invention.

Now, in a hair holder 101B of a preferred third embodiment of the second aspect of the invention, the section of the tube 102 indicating the endpoint 127 is formed broader in width than the other sections, constituting a broad section Q1. In the present embodiment, the stepped section indicating the endpoint 127 is also stepped in the width direction of the tube 102, as shown in FIG. 17.

In the hair holder 101B, the section excluding the broad section Q1 is referred to hereinbelow also as "narrow section Q'". In the hair holder 101B, the narrow section Q' is the section on the side of the lower end 126 with respect to the broad section Q1.

The broad section Q1 is rectangular and long in the lateral direction, the lateral direction thereof matching the width direction of the tube 102. The broad section Q1 extends outward, in the width direction, to the left and right from the respective edges of the narrow section Q' in the width direction, the extended left and right sections having approximately the same lengths.

The outer shape of each sheet 123 is the same as that of the hair holder 101B. The broad section Q1 is formed by joining, to the outer surface of the respective sheets 123, a pair of rectangular sheet pieces 103 and 103 long in the lateral direction. Each of the pair of sheet pieces 103 and 103 has the same shape as the section of the sheet 123 to which it is joined. More specifically, the sheet piece 103 has the same shape as the broad section Q1, and thus the broad section Q1 also constitutes the highly-rigid section P1.

A stepped section indicating the endpoint 127 is formed in the boundary between the broad section Q1 and the narrow section Q'. The section indicating the endpoint 127 also includes the planar section of the broad section Q1.

In terms of allowing clear tactile perception of the section indicating the endpoint 127 of the range for stroking the tube 102 as well as eliminating waste of material used for the sheets, it is preferable that the entire width W1 of the broad section Q1 (see FIG. 17) is 0.5 to 10 mm, and more preferably 1 to 5 mm, broader than the other section (i.e., the narrow section Q') of the hair holder 101B.

In terms of preventing the dyeing agent from leaking from the one-end opening 121, it is preferable that the length L1 of the broad section Q1 (see FIG. 17) is 5 to 100 mm, and more preferably 10 to 40 mm.

Figure 18:
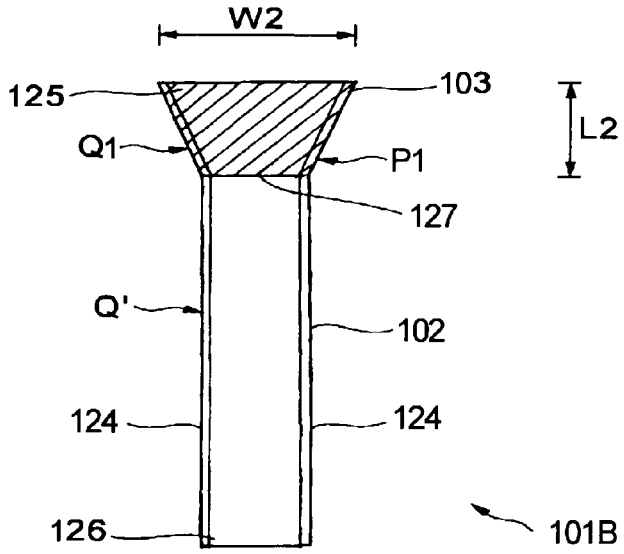
FIG. 18 is a plan view showing a modified example of the third embodiment of the second aspect of the invention.
Figure 19:
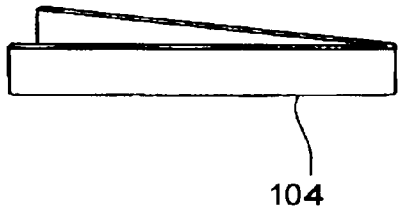
FIG. 19 is a perspective showing a tool for spreading and applying a hair treating agent.
Figure 20:
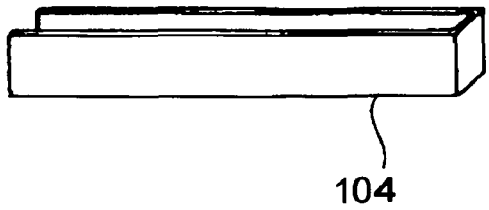
FIG. 20 is a perspective showing another tool for spreading and applying a hair treating agent.

The broad section Q1 may be trapezoidal in shape, as shown in FIG. 18. In terms of allowing clear tactile perception of the section indicating the endpoint 127 of the range for stroking the tube 102 as well as eliminating waste of material used for the sheets, it is preferable that the entire width W2 (see FIG. 18) is the same as that of the narrow section Q' at the stepped section and is 0.5 to 10 mm, and more preferably 1 to 5 mm, broader than the narrow section Q' at the upper end 125. In terms of preventing the dyeing agent from leaking from the one-end opening 121, it is preferable that the length L2 of the broad section Q1 (see FIG. 18) is 5 to 100 mm, and more preferably 10 to 40 mm.

Configuring the broad section Q1 as above allows the section indicating the endpoint 127 to be perceived tactilely and visually.

The hair holders 101, 101A, and 101B of the above-described first to third embodiments are configured so that, when spreading and applying the hair treating agent by stroking the tube 102 using a tool 104 that pinches the tube 102 and slides thereon, the tool 104 abuts against and stops at the stepped section indicating the endpoint 127.

Any kind of tool 104 can be employed as appropriate, as long as the tool 104 is shaped so that it can pinch the tube 102 and spread and apply the hair treating agent supplied to the tube 102 by stroking the tube from the side of the other-end opening 122 toward the one-end opening 121. A clip-type tool, such as the one shown in FIG. 19 or 20 for example, is preferable in terms that the structure is simple.

The hair treating agent supplied to the tube 102 is spread and applied by stroking the tube 102 from the side of the other-end opening 122 toward the one-end opening 121 using the tool 104, and the tool 104 abuts against the section indicating the endpoint 127 shaped according to either one of the above-described preferred first to third embodiments, thus allowing tactile perception. Also from a structural viewpoint, the sheet pieces 103 and the broad section Q1 can prevent the tool 104 from stroking the tube beyond the section indicating the endpoint 127.

This is described more specifically. The stepped section indicating the endpoint 127 projects outward in the thickness direction of the tube 102. Therefore, when the tool 104 pinches the tube 102 and slides thereon from the side of the lower end 126 of the tube 102 toward the upper end 125, the tool 104 abuts against and stops at the stepped section.

Using the tool 104 to stroke the tube 102 in this way allows the hair treating agent to be spread and applied easily and evenly to the entire hair bundle inside the tube 102.

Figure 21:
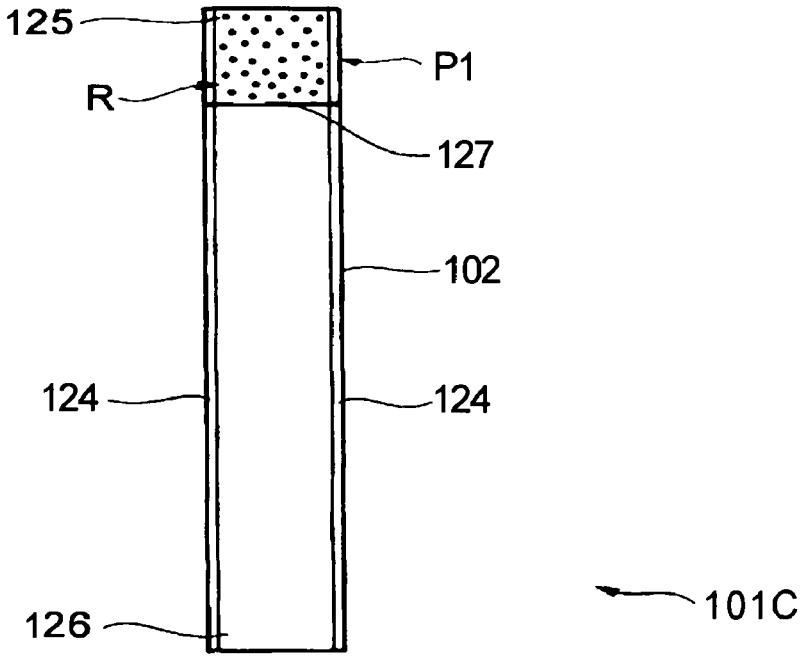
FIG. 21 is a plan view showing a fourth embodiment of a hair holder according to the second aspect of the invention.

Now, in a hair holder 101C of a preferred fourth embodiment of the present invention, the section of the tube 102 indicating the endpoint 127 has a surface roughness that is different from that of the other sections. Specifically, as shown in FIG. 21, the section indicating the endpoint 127 is formed so that its surface roughness is larger than that of the other sections.

The vicinity of the one-end opening 121 of the tube 102 has a pair of rectangular sheet pieces 103 and 103 joined to the respective outer surfaces of the pair of sheets 123 and 123 at the upper end 125 of the tube 102, and thus has a thickness that is larger than that of the other sections of the tube 102.

The outer surface of each of the pair of sheet pieces 103 and 103 is formed to have a surface roughness that is larger than that of the section of the sheet 123 of the tube 102 not having the sheet piece 103. Thus, the vicinity of the one-end opening 121 of the hair holder 101C has a large surface-roughness section R, as shown in FIG. 21. The stepped section formed by joining the sheet piece 103 to the sheet 123 also has a surface roughness that is larger than that of the section of the sheet 123 not having the sheet piece 103. In the present embodiment, the section R also constitutes the highly-rigid section P1.

The endpoint 127 is made up of the stepped section and the planar section of the sheet piece 103.

A difference of 10 μm or more between the surface roughness of the section R and the surface roughness Rz (ten-point average roughness) of the section of the sheet 123 not having the sheet piece 103 will allow the section indicating the endpoint 127 to be perceived tactilely and visually.

The surface roughness of the section R can be increased by using a material having a surface roughness larger than that of the sheet 123, such as a nonwoven fabric, as the sheet piece 103.

The section indicating the endpoint 127 may instead be formed so that its surface roughness is smaller than that of the other sections. This achieves the same effects as above. The surface roughness of the section R can be decreased, for example, by using a nonwoven fabric for the sheet 123 and using a material having a surface roughness smaller than that of the sheet 123, such as polyethylene, as the sheet piece 103.

The above-described hair holders 101A to 101C achieve the same effects as those of the hair holder 101 of the above-described first embodiment.

Figure 22:
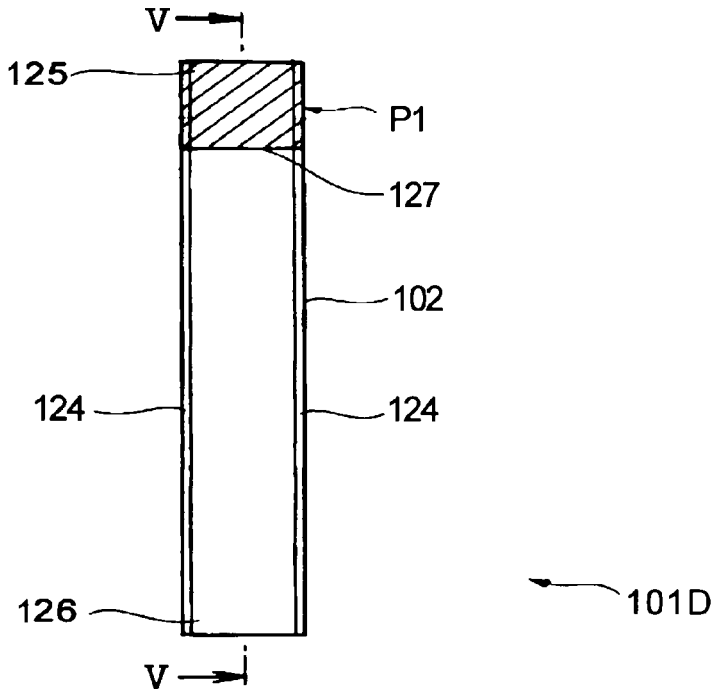
FIG. 22 is a plan view showing a fifth embodiment of a hair holder according to the second aspect of the invention.

Now, in a hair holder 101D of a preferred fifth embodiment of the present invention, the section of the tube indicating the endpoint 127 has a rigidity that is different from that of the other sections. In each of the pair of sheets 123 and 123, a section having a prescribed length from the edge of the tube on the side of the one-end opening 121 constitutes a highly-rigid section P1 having a rigidity higher than that of the other sections of the sheet 123, as shown in FIGS. 22 and 23.

The highly-rigid section P1 is a rectangular sheet, and its width is the same as that of the other sections of the sheet 123. In terms of allowing clear tactile perception of the section indicating the endpoint 127 of the range for stroking the tube 102, it is preferable that the length of the section P1 is 0.5 to 20 mm, and more preferably 1 to 5 mm.

Figure 23:
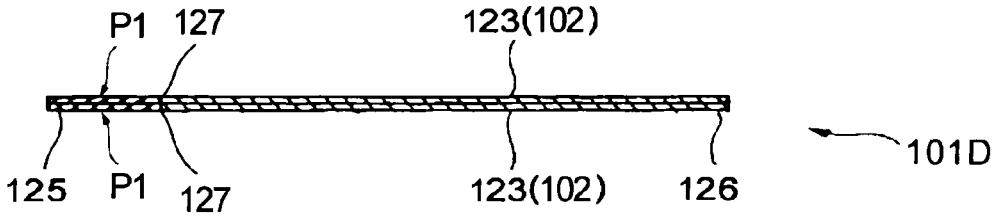
FIG. 23 is a cross-sectional view taken along line V-V of FIG. 22.

In each of the pair of sheets 123 and 123, the highly-rigid section P1 and the other section of the sheet 123 are joined together in such a manner that the difference in thickness cannot be recognized easily, as shown in FIG. 23. Specifically, the highly-rigid section P1 and the other section of the sheet 123 are joined in a slightly overlapped manner in order to secure manufacturability and joint strength. The manner of joining the two sections is not limited to the above, and the two sections may be butt-joined or joined in a completely overlapped manner.

The section indicating the endpoint 127 in the hair holder 101D of the present embodiment is the highly-rigid section P1 and the boundary between the highly-rigid section P1 and the other section of the sheet 123. As the tube 102 is stroked with the fingers from the side of the lower end 126 toward the upper end 125, the change in rigidity of the tube 102 can clearly be perceived tactilely on reaching the boundary. Thus, the endpoint of the range for stroking the tube 102 can be perceived easily.

This is described in more detail. The section of the highly-rigid section P1 that is tactilely perceived as the section indicating the endpoint 127 by stroking the tube 102 with the fingers also includes the planar section of the highly-rigid section P1, because the fingertip is a part of the body that occupies a prescribed area.

In terms of securing the flexibility of the tube 102, it is preferable that the Taber stiffness of the sheet 123 ranges from 0.5 to 10 mN·m. The Taber stiffness of the highly-rigid section P1 is larger than that of the sheet 123, and its preferable range is the same as that of the foregoing embodiment.

It is also preferable that the highly-rigid section P1 is colored to have a different color from that of the other sections of the tube 102 in order to allow the section indicating the endpoint 127 of the range for stroking the tube 102 to be perceived also visually.

The above-described hair holder 101D of the present embodiment achieves the same effects as those of the hair holder 101 of the above-described first embodiment.

The hair holders of the second aspect of the invention are not limited to the foregoing embodiments, and can be modified as appropriate as long as they do not depart from the spirit and scope of the second aspect of the invention.

For example, in the hair holders 101, 101A, and 101B of the first to third embodiments of the second aspect of the invention, the sheet pieces 103 are formed as separate components from the pair of sheets 123 and 123; however, the sheet pieces 103 of the present invention may be formed integrally with the pair of sheets 123 and 123, respectively. Further, the sheet piece 103 in the hair holders 101, 101A, and 101B of the first to third embodiments is a flat sheet, but the sheet piece 103 in the present invention may have projections and depressions. Further, in the hair holder 101B of the third embodiment, the section constituting the highly-rigid section P1 in the sheet 123 may be colored to have a different color from that of the other sections of the sheet 123 and may have the same rigidity as that of the other sections of the sheet 123.

Further, in the hair holders 101, 101A, and 101B of the first to third embodiments, the section indicating the endpoint 127 is stepped in the thickness direction of the tube 102, but instead of providing a step, the section may be gently sloped. Even in this case, the vicinity of the one-end opening 121 will serve as an endpoint because its thickness is larger than the other sections. Moreover, in the hair holders 101, 101A, and 101B of the first to third embodiments, the section indicating the endpoint 127 is formed thicker than the other sections; the section indicating the endpoint 127, however, may instead be formed thinner than the other sections. Further, in the hair holder 101D of the fifth embodiment, the section indicating the endpoint 127 is formed having a higher rigidity than the other sections; the section indicating the endpoint 127, however, may instead be formed having a lower rigidity than the other sections.

The dyeing agent, which serves as the hair treating agent, may be supplied to the tube 102 from the one-end opening 121 and be spread and applied by stroking the tube 102 toward the other-end opening 122. In this case, it is preferable to provide the above-described sealing means on the lower end 126 of the tube 102 or apply joining means such as heat sealing thereto, in order to prevent the dyeing agent supplied into the tube 102 from flowing out from the other-end opening 122. In this case, it is preferable to provide the section of the tube 102 indicating the endpoint 127 in the vicinity of the other end.

Permanent-straightening treatment is also preferably carried out using the hair holder of the present invention.

The tool 104 can be used—even in cases where the endpoint 127 is not the stepped section—as long as the section either has a larger surface roughness, has a different rigidity, or is colored to have a different color as compared with the other sections, because in such cases, the section can be perceived tactilely and/or visually as the "section indicating the endpoint".

Next, a hair holder 201 according to still another embodiment of the second aspect of the invention is described with reference to the drawings. The hair holder 201 has, as leak-prevention marks for preventing a hair treating agent from leaking out from a tube 202, marks 225 and 226 that allow the amount of hair treating agent supplied to the tube 202 to be adjusted to a given amount.

Figure 24:
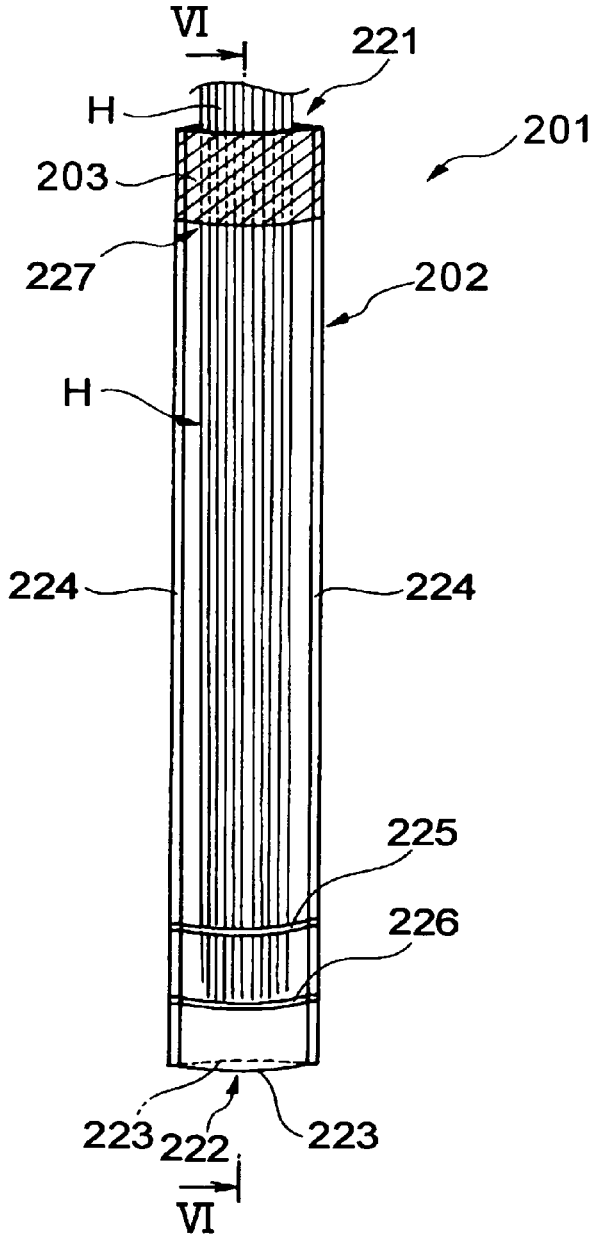
FIG. 24 is a perspective showing still another embodiment of a hair holder according to the second aspect of the invention.
Figure 25:
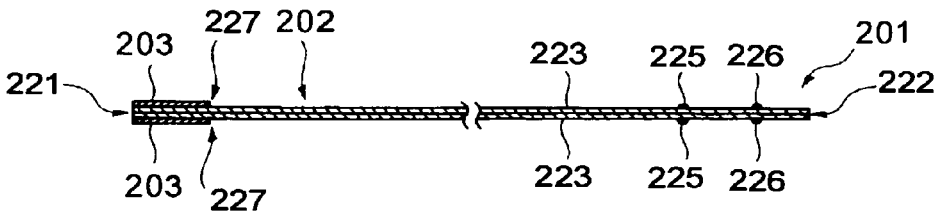
FIG. 25 is a cross-sectional view taken along line VI-VI of FIG. 24.
Figure 26A:
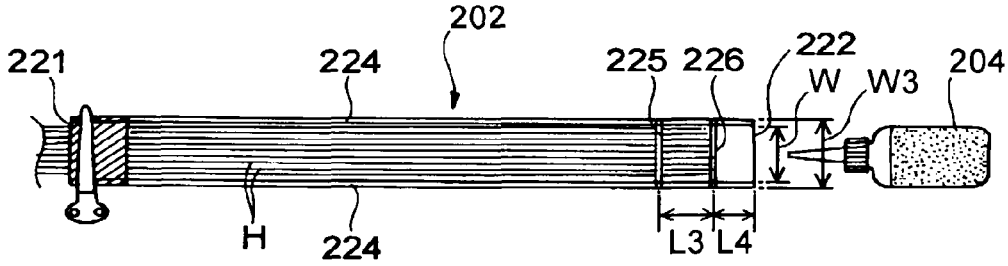
FIGS. 26(*a*) to 26(*d*) are schematic diagrams showing how dyeing treatment is applied using the hair holder of FIG. 24, wherein FIG. 26(*a*) shows a state in which a hair bundle has been inserted into the hair holder, FIG. 26(*b*) shows how a dyeing agent is supplied to the hair holder, FIG. 26(*c*) shows a state before stroking the hair holder, and FIG. 26(*d*) shows how the hair holder is stroked to spread and apply the dyeing agent.
Figure 26B:
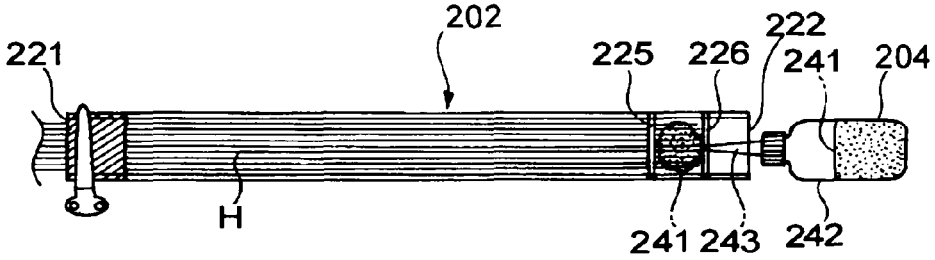
Figure 26C:
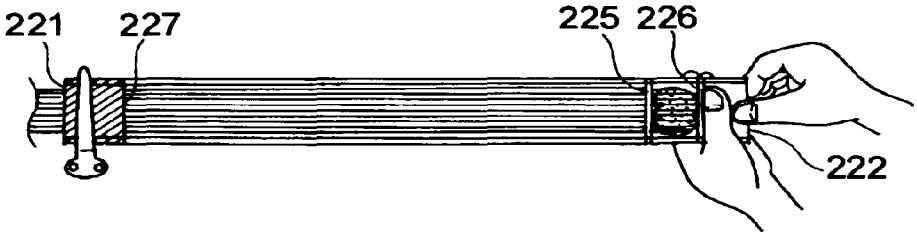
Figure 26D:
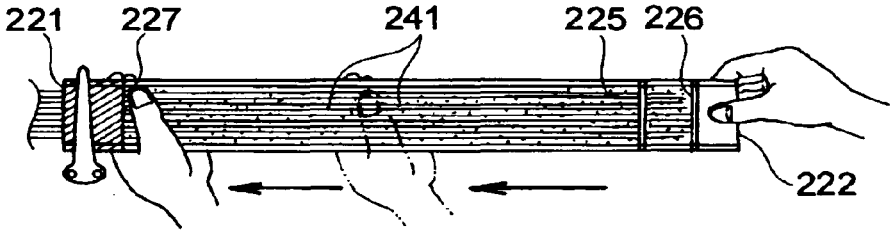

As shown in FIGS. 24 to 26, the hair holder 201 is made of a tube 202 that is formed of a pair of sheets 223 and 223 and so designed that a hair bundle H can be inserted from an opening 221 at one end toward an opening 222 at the other end. The hair holder 201 is so structured that a dyeing agent, which serves as a hair treating agent, supplied to the tube 202 can be spread and applied onto the hair bundle H having been inserted into the tube 202 from the one-end opening 221 by stroking the tube 202 from the side of the other-end opening 222 toward the one-end opening 221, and is used for dyeing the hair bundle H.

Further, in the hair holder 201 of the present embodiment, a mark 225 (a first mark) and a mark 226 (a second mark) that allow the amount of dyeing agent (hair treating agent) supplied to the tube 202 to be adjusted to a given amount are provided in the vicinity of the other-end opening 222 of the tube 202. The second mark 226 is provided closer to the other-end opening 222, and the first mark 225 is spaced from the second mark and provided closer to the one-end opening 221.

The hair holder 201 of the present embodiment is described in detail below.

As shown in FIG. 24, the tube 202 is long in its length direction and is so structured that the hair bundle H can be inserted from the one-end opening 221 toward the other-end opening 222. The tube 202 is formed by joining a pair of long rectangular sheets 223 and 223 together at their lengthwise side edges 224 and 224. The pair of sheets 223 and 223 is soft and thus the tube 202 is flexible.

The length of the tube 202 is set appropriately depending on the length of the hair to be treated, and is preferably longer than the length of the hair to be treated. Each opening 221, 222 of the tube 202 has an elliptic or circular shape, and its size is set appropriately depending on the amount of the hair bundle to be inserted.

Generally, the length of the tube 202 ranges approximately from 50 to 600 mm, and the size of each opening 221, 222 ranges approximately from 5 to 100 mm in major diameter and approximately from 2 to 40 mm in minor diameter. The openings 221 and 222 of the tube 202 are circular when the major diameter is equal to the minor diameter.

As shown in FIGS. 26(*a*) to 26(*d*), the hair holder 201 is preferably used for subjecting the hair bundle H to dyeing treatment inside the tube 202 by spreading and applying the dyeing agent supplied to the tube 202 onto the hair bundle H having been inserted into the tube 202 from the one-end opening 221 through stroking of the tube 202 from the side of the other-end opening 222 toward the one-end opening 221. In carrying out the dyeing treatment, it is preferable to position the side of the one-end opening 221 up and the side of the other-end opening 222 down, with respect to the length direction of the tube 202.

The pair of sheets 223 and 223 is made of a material impermeable to dyeing agents, and therefore, no dyeing agent leaks out from the side surfaces of the tube 202. This prevents hair other than the hair bundle inserted in the hair holder 201 from being dyed. Accordingly, the dyeing treatment using the hair holder 201 of the present embodiment is particularly effective in partially dyeing the hair on one's head.

The dyeing agent exists in the hair holder 201 in a relatively sealed state. Therefore, in cases where the dyeing agent includes volatile components, such components are prevented from volatilizing during dyeing. Accordingly, the hair holder is advantageous in that the dyeing treatment can be performed efficiently.

The same material as that of the sheets 123 and 123 in the above-described hair holder 101 is preferably used for forming the above-described pair of sheets 223 and 223.

In the hair holder 201 of the present embodiment, the two marks 225 and 226 described above are provided in the form of projecting ribs in the vicinity of the other-end opening 222 of the tube 202 as the marks that allow the amount of hair treating agent supplied to the tube 202 to be adjusted to a given amount. Assuming that the entire length of the tube 202 is divided into four equal regions, both of the two marks 225 and 226 in the present embodiment are located in the region closest to the opening 222. Further, even when assuming that the entire length of the tube 202 is divided into three equal regions, both marks 225 and 226 are likewise located in the region closest to the opening 222.

As shown in FIG. 25, the two marks 225 and 226 are formed on each of the pair of sheets 223 and 223, and each mark is formed extending in a direction orthogonal to the length direction of the tube 202 (i.e., in the width direction of the sheet 223). For example, each of the two marks 225 and 226 is obtained by melting a thermoplastic resin, e.g., ethylene/vinyl acetate copolymer resin or a polyolefin-type resin such as polyethylene and polypropylene, linearly applying the molten resin to one side of the sheet 223, and curing the resin.

From the viewpoint of improving visibility, it is preferable that the marks 225 and 226 are colored.

The two marks 225 and 226 function sufficiently as long as their positions can be visually perceived. However, it is preferable that the length of each mark in the same direction as the width direction of the sheet 223 is 30% to 100%, and more preferably 70% to 100%, of the width W3 of the sheet 223 (see FIG. 26(*a*)).

In supplying a hair treating agent 241 from a container 204 such as a bottle, the two marks 225 and 226 allow the amount of hair treating agent supplied to the tube 202 to be adjusted to a given amount by allowing the hair treating agent 241 to be supplied so that it spreads out between the first mark 225 and the second mark 226, as shown in FIG. 26(*b*).

The "given amount" is such an amount that allows hair treatment to be applied evenly to the hair bundle H inserted inside the tube 202 while preventing, to the extent possible, supplying of a more-than-necessary amount of hair treating agent, and is set in advance. It is preferable to determine this amount based, for example, on the amount of hair bundle to be inserted into the tube, the length and width of the tube, and/or the viscosity of the hair treating agent.

The spacing L3 between the two marks 225 and 226 in the length direction of the tube 202 (see FIG. 26(*a*)) relates to the maximum width W of the inside of the tube 202 (which is equal to the width between the joined side edges 224 and 224 of the sheets 223 and 223; see FIG. 26(*a*)); in cases where the above width W is 20 to 30 mm for example, the spacing L3 between the marks 225 and 226 is preferably 20 to 60 mm, and more preferably 20 to 40 mm, from the viewpoint of applying hair treatment evenly and preventing leakage of the hair treating agent due to excessive use thereof. Further, it is preferable to set the spacing L3 between the two marks 225 and 226 to such a distance that the amount of hair treating agent suppliable between the marks and between the sheets 223 and 223 is 3 to 20 ml, and more preferably 5 to 10 ml.

The pair of sheets 223 and 223 in the present embodiment is transparent and colorless. In either one, or both, of the sheets 223 and 223 constituting the tube 202, it is preferable that at least the section located between the two marks 225 and 226 is transparent, it is more preferable that the range from the other-end opening 222 to the first mark 225 is transparent, and it is even more preferable that the entire area or almost the entire area of the tube 202 in its length direction, including the above-described sections, is transparent. The term "transparent" also includes "transparent and colored".

In the hair holder 201 of the present embodiment, the second mark 226—of the two marks 225 and 226—closer to the other-end opening 222 serves as a mark for indicating an appropriate depth to which the bottle (container) 204 should be inserted when supplying the hair treating agent 241 filled in the bottle 204 to the tube 202, as shown in FIG. 26(*b*).

More specifically, the bottle 204 shown in FIGS. 26(*a*) and 26(*b*) has a container section 242 containing the hair treating agent 241 and a tapered supplying section 243 projecting from the container section 242 and having a supplying orifice in its tip end. In inserting the supplying section 243 of the bottle 204 into the tube 202, it is inserted so that the tip end of the supplying section 243 reaches the position of the second mark 226 as shown in FIG. 26(*b*), and the hair treating agent 241 is supplied in this state. This allows the hair treating agent 241 to be prevented from leaking from the other-end opening 222 of the tube 202. From the viewpoint of surely achieving this effect, it is preferable to provide the second mark 226 so that the distance L4 thereto from the other-end opening 222 in the length direction of the tube 202 (see FIG. 26(*a*)) ranges from 20 to 80 mm, and more preferably from 20 to 40 mm.

The hair holder 201 of the present embodiment is described in further detail. It is possible to prevent the dyeing agent from leaking from the one-end opening 221 just by providing the above-described first and second marks. However, in order to surely prevent leakage and provide a sense of security to the user, the hair holder 201 is structured so that the endpoint of the range for stroking the tube 202 can be perceived tactilely and visually.

Specifically, as shown in FIG. 25, a stepped section 227 having a step in the thickness direction of the tube 202 is formed in the vicinity of the one-end opening 221, and this stepped section 227 constitutes the endpoint of the range for stroking the tube 202. That is, as the user strokes the tube 202 from the side of the other-end opening 222 toward the one-end opening 221 with the fingers, the fingers abut against the stepped section 227. This prevents stroking of the tube 202 beyond this point. This stepped section 227 can also be perceived visually.

As shown in FIG. 25, the stepped section 227 in the present embodiment is formed by joining a rectangular sheet piece 203 to the outer surface of each sheet 223. It is preferable that the thickness of the sheet piece 203 is 0.1 to 5 mm, and more preferably 0.5 to 2 mm.

In applying dyeing treatment using the hair holder 201 of the present embodiment, it is preferable to insert a hair bundle H from the one-end opening 221 into the tube 202 using a hair inserter (not shown). A preferable hair inserter has a latch-hook at one end thereof for hooking a hair bundle H and a grip at the other end, and is used inside the hair holder 201 in such a state that the latch-hook projects outward from the one-end opening 221 of the tube 202 and the grip projects outward from the other-end opening 222. The specifications etc. of JP2003-93133 A and US2004/216759 A1 mentioned above disclose examples of such a hair inserter.

The following describes an embodiment of dyeing treatment using the above-described hair holder 201 and the hair inserter. In terms of dyeing the entire hair bundle H, it is preferable that the length of the tube 202 of the hair holder 201 used for dyeing is longer than the length of the hair bundle H.

First, the hair holder 201 is prepared with the latch-hook of the hair inserter extending outward from the one-end opening 221, the grip extending outward from the other-end opening 222, and the hair inserter inserted inside the tube 202.

Next, the hair bundle H is hooked into the hair inserter's latch-hook. In this state the grip is pulled, and this inserts the hair bundle H into the tube 202. The hair bundle H is brought into a generally linear, straightened state inside the tube 202, as shown in FIG. 26(*a*).

Then, as shown in FIG. 26(*b*), a liquid dyeing agent is supplied into the tube 202 from the other-end opening 222 thereof using the bottle 204 containing the dyeing agent.

In supplying the agent, the supplying section 243 of the bottle 204 is inserted so that its tip end reaches the position of the second mark 226, and the dyeing agent 241 is supplied in this state. The dyeing agent 241 is supplied until the edge of the dyeing agent 241 reaches the first mark 225 as shown in FIG. 26(*b*), and supplying is terminated when the edge reaches the first mark 225.

After withdrawing the bottle 204 from the tube 202, the user holds a section between the other-end opening 222 and the second mark 226 of the hair holder 201 with both hands as shown in FIG. 26(*c*). Then, as shown in FIG. 26(*d*), while holding that section with one hand, the user strokes the tube 202 from both sides with the fingers of the other hand from the side of the other-end opening 222 toward the side of the one-end opening 221, to spread and apply the dyeing agent 241 onto the hair bundle H.

The fingers of the other hand abut against the stepped section 227 indicating the endpoint of the range for stroking the hair holder 201, which prevents stroking of the holder beyond this point.

Due to stroking of the tube 202, the dyeing agent inside the tube 202 moves from the side of the other-end opening 222 toward the side of the one-end opening 221 while moistening the hair; the portion of the hair bundle H on the side of the opening 221 beyond the stepped section 227 is dyed using a remaining portion of the dyeing agent that has moved by being stroked up to the section indicating the stepped section 227.

The hair holder 201 of the present embodiment allows a given amount of dyeing agent 241 set in advance to be supplied to the tube 202 through a simple operation of supplying the dyeing agent 241 from the second mark 226 up to the first mark 225. Therefore, by setting this supply amount to such an amount that allows hair treatment to be applied evenly to the hair bundle H inserted in the tube 202 while preventing, to the extent possible, supplying of a more-than-necessary amount of hair treating agent, it is possible to carry out the hair treatment efficiently without causing any leakage or shortage of the hair treating agent.

Note that in cases where a stepped section 227 etc. indicating the endpoint of the stroking range is provided as in the hair holder 201 of the present embodiment, the dyeing agent moves also onto the side of the opening 221 beyond the stepped section 227 etc. Therefore, it is preferable to determine the positions of the second mark 226 and the first mark 225 so that the supply amount is such that the dyeing agent does not leak from the opening 221.

After repeating the same operation using a plurality of hair holders 201 if desired, the hair holders are left as they are for a prescribed amount of time. After this time, the hair bundle H is removed from the hair holder 201. Preferably, the hair is then rinsed and is also shampooed and blow-dried.

The configuration for providing, as the leak-prevention mark, a mark(s) allowing the amount of hair treating agent supplied to the tube to be adjusted to a given amount is not limited to the above-described embodiment, but can be modified as appropriate as long as it does not depart from the spirit and scope thereof.

Figure 27A:
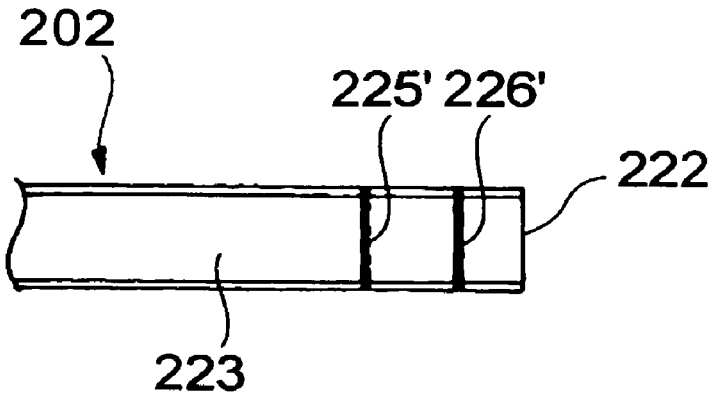
FIG. 27(*a*) and FIG. 27(*b*) are plan views showing a primary part of still another embodiment of a hair holder according to the second aspect of the invention.
Figure 27B:
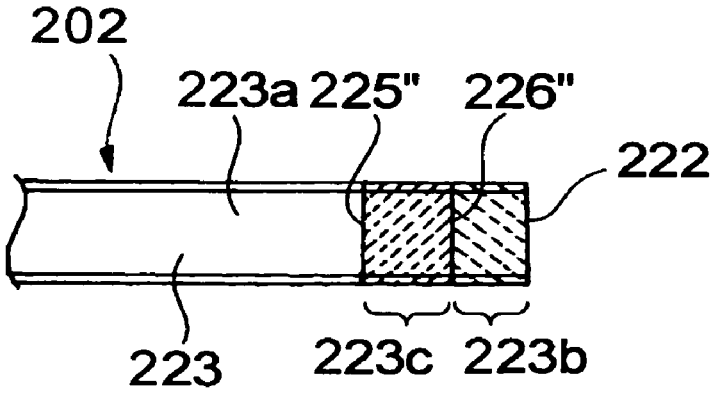

For example, as shown in FIG. 27(*a*), two lines 225' and 226' may be presented on each sheet 223 constituting the tube 202 through printing etc. as the marks that allow the amount of hair treating agent supplied to the tube 202 to be adjusted to a given amount. In this case, the two lines 225' and 226' may be printed on either the outer-surface side or the inner-surface side of the tube 202 and may or may not project from the surface of the sheet 223, as long as they are visible. Further, discontinuous projections or dots, for example, may be provided in a row in the width direction of the sheet 223 and these may be employed as the marks in the present invention, instead of the projecting-rib-like marks 225 and 226 or the linear marks 225' and 226' continuously extending in the width direction of the sheet 223. Also, in cases of forming projecting ribs as the marks, such projecting ribs may be formed in any way, such as by bonding a material of any type to the sheet 223 or by integrally forming the projecting ribs on the sheet 223.

Further, as shown in FIG. 27(*b*), two regions 223*b* and 223*c* each having a different color from the other section 223*a* may be provided on the sheet 223 constituting the tube 202, and the borderlines 225" and 226" appearing between the adjacent regions may serve as the marks that allow the amount of hair treating agent supplied to the tube 202 to be adjusted to a given amount. Further, instead of providing the two regions 223*b* and 223*c* each having a different color from the other section 223*a* of the tube 202, it is also possible to provide only a single region 223*c* having a different color from the other section 223*a* and employ the borderlines appearing between the region 223*c* and each of the sections sandwiching the region 223*c* from both sides as the marks that allow the amount of hair treating agent supplied to the tube 202 to be adjusted to a given amount. The two regions 223*b* and 223*c* may be regions made, for example, of transparent and colored sheets.

As described above, even when providing the two lines 225' and 226' or the two borderlines 225" and 226" as the marks, the positioning of the two lines/borderlines and the spacing therebetween can be adjusted so that they are the same as those of the projecting-rib marks 225 and 226 in the foregoing embodiment.

It is also possible to provide three or more projecting ribs, lines, borderlines, or the like on the tube 202, and select and employ two of the projecting ribs etc. as the marks, depending on the type of hair treating agent to be used.

The features of one of the foregoing embodiments of the present invention that have been omitted from explanation and elements provided only in one embodiment are applicable to the other embodiments as appropriate, and the elements in each embodiment are interchangeable among the embodiments as appropriate.

The following describes the present invention (the first aspect of the invention) in further detail by means of examples. Note that the present invention is not limited in any way by the following examples.

EXAMPLE 1

A hair holder having the shape as shown in FIGS. 1 to 3 was prepared using a hair-treating-agent leak-prevention member made of a material described below. The length of the tube was 400 mm, and the distance W from one side end to the other side end of the tube was 30 mm. The material used for the pair of sheets 23 and 23 was low-density polyethylene.

Material for Hair-Treating-Agent Leak-Prevention Member:

Two-component spunbond nonwoven fabric using sheath/core structure fiber

Core: polyester

Sheath: polyethylene

Basis weight: 40 g/m$^2$

Available from Kao Corporation

Thickness T1 under load of 3.7 g/cm$^2$: 0.56 mm

Thickness T2 under load of 204 g/cm$^2$: 0.27 mm

Difference in thickness between T1 and T2: 0.29 mm

The prepared hair holder was subjected to the following evaluation tests according to the following test procedure, and evaluation was made as follows as to whether or not the dyeing agent leaked from the one-end opening of the hair holder and whether or not the hair holder slipped out of position. The results are shown in Table 1.

Test Procedure:

(1) Insert a hair bundle (having approximately 1000 pieces of hair) approximately 250 mm long from the one-end opening 21 of the tube 2 toward the other-end opening 22.

(2) As shown in FIG. 3, pinch the section P where the hair-treating-agent leak-prevention members are provided with the clip-type fixing member shown in FIG. 5, to fix the hair holder to the hair bundle (fixing force: 1 N).

(3) Supply 5 g of dyeing agent from the other-end opening of the hair holder.

(4) Spread and apply the supplied dyeing agent by stroking the hair holder in the direction from the other-end opening toward the one-end opening with the fingers of the hand.

Evaluation on Whether or not Dyeing Agent Leaked:

After spreading and applying the dyeing agent, the leakage condition of the dyeing agent from the one-end opening of the hair holder is confirmed through visual inspection. Whether or not leakage occurred is judged based on the amount of leakage that can be confirmed through visual inspection (an amount of around several milligrams or more).

Evaluation on Whether or not Hair Holder Slipped Out of Position:

Whether the hair holder slipped out of position during the above-described test is confirmed through visual inspection. Whether or not slippage occurred is judged based on the amount of slippage that can be confirmed through visual inspection (an amount of around 1 mm or more).

EXAMPLE 2

The material used for the hair-treating-agent leak-prevention member was changed to the following. Other than this, the foregoing evaluations were made in the same way as in EXAMPLE 1. The results are shown in Table 1.

Material for Hair-Treating-Agent Leak-Prevention Member:

Non-crosslinked highly-foamed polyethylene sheet

Available from Sakai Chemical Group under trade name "Minafoam"

Thickness T1 under load of 3.7 g/cm$^2$: 0.52 mm

Thickness T2 under load of 204 g/cm$^2$: 0.4 mm

Difference in thickness between T1 and T2: 0.12 mm

COMPARATIVE EXAMPLE 1

The material used for the hair-treating-agent leak-prevention member was changed to the following. Other than this, the foregoing evaluations were made in the same way as in EXAMPLE 1. The results are shown in Table 1.

Material for Hair-Treating-Agent Leak-Prevention Member:

Low-density polyethylene film (nominal thickness: 40 μm)
Thickness T1 under load of 3.7 g/cm$^2$: 0.04 mm
Thickness T2 under load of 204 g/cm$^2$: 0.036 mm
Difference in thickness between T1 and T2: 0.004 mm

COMPARATIVE EXAMPLE 2

The material used for the hair-treating-agent leak-prevention member was changed to the following. Other than this, the foregoing evaluations were made in the same way as in EXAMPLE 1. The results are shown in Table 1.

Material for Hair-Treating-Agent Leak-Prevention Member:

Spunbond nonwoven fabric using polyester fiber
Basis weight: 250 g/m$^2$
Available from Asahi Kasei Corporation under trade name "Eltas Smash"
Thickness T1 under load of 3.7 g/cm$^2$: 0.57 mm
Thickness T2 under load of 204 g/cm$^2$: 0.54 mm
Difference in thickness between T1 and T2: 0.03 mm

TABLE 1

| | | Hair-treating-agent leak-prevention member | | | | Evaluation | |
|---|---|---|---|---|---|---|---|
| | | Material | T1 (mm) | T2 (mm) | T1 − T2 (mm) | Leakage | Slippage |
| Example | 1 | Spunbond nonwoven fabric | 0.56 | 0.27 | 0.29 | No | No |
| | 2 | Polyethylene sheet | 0.52 | 0.4 | 0.12 | No | No |
| Comparative example | 1 | Polyethylene film | 0.04 | 0.036 | 0.004 | Yes | Yes |
| | 2 | Spunbond nonwoven fabric | 0.57 | 0.54 | 0.03 | Yes | Yes |

As shown in Table 1, EXAMPLES 1 and 2 showed favorable results, in that neither dyeing-agent leakage nor hair-holder slippage was confirmed through visual inspection.

In contrast, COMPARATIVE EXAMPLES 1 and 2 did not show favorable results, in that both dyeing-agent leakage and hair-holder slippage were confirmed through visual inspection.

INDUSTRIAL APPLICABILITY

According to the hair holder of the first aspect of the invention, the tube can be fixed to the hair bundle stably, and the hair treating agent supplied to the tube is less prone to leak from the tube when it is spread and applied to the hair bundle. Further, with the present aspect of the invention, the hair-treating-agent leak-prevention member can reduce the burden on the hair bundle when the hair holder is fixed thereto, thus allowing damages caused to the hair to be reduced.

According to the hair holder of the second aspect of the invention, the hair treating agent does not leak out from the tube when it is spread and applied onto the hair bundle inside the tube by stroking the tube.

The hair holder that has, as the leak-prevention mark, a mark that allows the amount of hair treating agent supplied to the tube to be adjusted to a given amount enables the amount of hair treating agent supplied to be adjusted easily and achieves efficient hair treatment without causing any leakage or shortage of the hair treating agent.

What is claimed is:

1. A hair holder comprising:

a tube configured to allow a hair bundle to be inserted from a one-end opening at one end of the tube toward an other-end opening at the other end thereof, the hair holder being designed to allow hair treatment to be applied inside the tube to the hair bundle by supplying a hair treating agent into the tube, wherein a hair-treating-agent leak-prevention member is provided on an inner-surface side of the tube in a vicinity of the one-end opening, the hair-treating-agent leak-prevention member achieving an effect of preventing leakage of the agent when pressed against the hair bundle, a section indicating an endpoint of a range for stroking the tube in such a manner that the endpoint can be perceived tactilely or visually is provided as a leak-prevention mark, and a stepped section indicating the endpoint is provided to the tube as the section indicating the endpoint.

2. The hair holder according to claim 1, wherein the hair-treating-agent leak-prevention member, when pressed against the hair bundle, is deformable to conform to a projecting-and-depressed shape of a surface of the hair bundle.

3. The hair holder according to claim 1, wherein the hair-treating-agent leak-prevention member is made of a porous material capable of being impregnated with and holding the hair treating agent.

4. The hair holder according to claim 3, wherein the porous material is a nonwoven fabric.

5. The hair holder according to claim 4, wherein the nonwoven fabric has a sheath/core structure fiber where the sheath and the core are different materials.

6. The hair holder according to claim 5, wherein the sheath is a polyethylene and the core is a polyester.

7. The hair holder according to claim 3, wherein the leak-prevention member is a non-crosslinked highly-foamed polyethylene sheet.

8. The hair holder according to claim 1, wherein the hair holder is used in combination with a fixing member capable of pinching a section of the tube where the hair-treating-agent leak-prevention member is provided.

9. The hair holder according to claim 8, wherein the fixing member is capable of applying a fixing force of 0.4 N or more.

10. The hair holder according to claim 1, further comprising sealing means in a vicinity of the other-end opening of the tube, the sealing means allowing the other-end opening to be opened and closed.

11. The hair holder according to claim 1, wherein the leak-prevention member includes two parts provided on the inner-surface side of the tube so as to oppose each other so as to be pressed together against the hair bundle, with the hair bundle between the two parts, to achieve the effect of preventing leakage of the agent.

12. The hair holder according to claim 1, wherein the stepped section is stepped in a thickness direction of the tube.

13. A hair holder comprising:

a tube formed of a sheet in such a design as to allow a hair bundle to be inserted from a one-end opening at one end of the tube toward the other end thereof, the hair holder being designed to allow a hair treating agent supplied to the tube to be spread and applied onto the hair bundle having been inserted into the tube from the one-end opening by stroking of the tube, wherein the hair holder has a leak-prevention mark to prevent the hair treating agent from leaking out from the tube a section indicating an endpoint of a range for stroking the tube in such a manner that the endpoint can be perceived tactilely or visually is provided as the leak-prevention mark, and a stepped section indicating the endpoint is provided to the tube as the section indicating the endpoint.

14. The hair holder according to claim 13, wherein the section of the tube indicating the endpoint is provided in a vicinity of the one-end opening.

15. The hair holder according to claim 13, wherein the section of the tube indicating the endpoint is provided in a vicinity of the other end.

16. The hair holder according to claim 13, wherein the stepped section is stepped in a thickness direction of the tube.

17. The hair holder according to claim 13, wherein the stepped section is stepped in a width direction of the tube.

18. The hair holder according to claim 13, wherein the section of the tube indicating the endpoint is formed broader in width than other sections of the tube.

19. The hair holder according to claim 13, wherein the section of the tube indicating the endpoint has a surface roughness that is different from the other sections of the tube.

20. The hair holder according to claim 13, wherein the section of the tube indicating the endpoint has a rigidity that is different from the other sections of the tube.

21. The hair holder according to claim 13, wherein the section of the tube indicating the endpoint is colored to have a different color from the other sections of the tube.

22. The hair holder according to claim 13, wherein the tube is stroked using a tool that pinches the tube and slides thereon to spread and apply the hair treating agent.

23. The hair holder according to claim 13, wherein:

the leak-prevention mark is a mark that allows an amount of the hair treating agent supplied to the tube to be adjusted to a given amount, and the mark is provided in a vicinity of an other-end opening at the other end of the tube.

24. The hair holder according to claim 23, wherein, in a case where a hair treating agent filled in a container is to be supplied to the tube, a mark indicating an appropriate depth to which the container should be inserted is provided in the vicinity of the other-end opening.

25. The hair holder according to claim 24, wherein the mark indicating the appropriate insertion depth is provided so that a distance thereto from the other-end opening in a length direction of the tube ranges from 20 to 80 mm.

26. The hair holder according to claim 13, wherein the endpoint can be perceived tactilely or visually as the leak-prevention mark at a plurality of locations along an outer surface of the tube.

* * * * *